US009536533B2

(12) United States Patent
Baeckstroem et al.

(10) Patent No.: US 9,536,533 B2
(45) Date of Patent: Jan. 3, 2017

(54) LINEAR PREDICTION BASED AUDIO CODING USING IMPROVED PROBABILITY DISTRIBUTION ESTIMATION

(71) Applicant: Fraunhofer-Gesellschaft zur Foerderung der angewandten Forschung e.V., Munich (DE)

(72) Inventors: Tom Baeckstroem, Nuremberg (DE); Christian Helmrich, Erlangen (DE); Guillaume Fuchs, Erlangen (DE); Markus Multrus, Nuremberg (DE); Martin Dietz, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 190 days.

(21) Appl. No.: 14/574,830

(22) Filed: Dec. 18, 2014

(65) Prior Publication Data

US 2015/0106108 A1 Apr. 16, 2015

Related U.S. Application Data

(63) Continuation of application No. PCT/EP2013/062809, filed on Jun. 19, 2013.
(Continued)

(51) Int. Cl.
*G10L 19/00* (2013.01)
*G10L 19/04* (2013.01)
(Continued)

(52) U.S. Cl.
CPC ..... *G10L 19/04* (2013.01); *G10L 19/02* (2013.01); *G10L 19/08* (2013.01); *G10L 19/0017* (2013.01); *G10L 19/032* (2013.01); *G10L 25/12* (2013.01)

(58) Field of Classification Search
CPC ..... G10L 19/06; G10L 19/08; G10L 19/09; G10L 25/12
(Continued)

(56) References Cited

U.S. PATENT DOCUMENTS 5,822,723 A * 10/1998 Kim ..... G10L 19/07 704/219
2002/0010577 A1 1/2002 Matsumoto et al.
(Continued)

FOREIGN PATENT DOCUMENTS

EP 1 278 184 A2 1/2003
EP 2 077 550 A1 7/2009
(Continued)

OTHER PUBLICATIONS

Official Communication issued in corresponding Korean Patent Application No. 10-2015-7001849, mailed on Dec. 16, 2015.
(Continued)

*Primary Examiner* — Daniel Abebe
(74) *Attorney, Agent, or Firm* — Keating & Bennett, LLP

(57) ABSTRACT

Linear prediction based audio coding is improved by coding a spectrum composed of a plurality of spectral components using a probability distribution estimation determined for each of the plurality of spectral components from linear prediction coefficient information. The linear prediction coefficient information is available anyway. Accordingly, it may be used for determining the probability distribution estimation at both encoding and decoding side. The latter determination may be implemented in a computationally simple manner by using, for example, an appropriate parameterization for the probability distribution estimation at the plurality of spectral components. The coding efficiency as provided by the entropy coding is compatible with probability distribution estimations as achieved using context
(Continued)

selection, but its derivation is less complex. The derivation may be purely analytically and/or does not require any information on attributes of neighboring spectral lines such as previously coded/decoded spectral values of neighboring spectral lines as is the case in spatial context selection.

30 Claims, 12 Drawing Sheets

Related U.S. Application Data

(60) Provisional application No. 61/665,485, filed on Jun. 28, 2012.

(51) Int. Cl.

| | |
|---|---|
| ***G10L 19/02*** | (2013.01) |
| ***G10L 19/08*** | (2013.01) |
| *G10L 25/12* | (2013.01) |
| *G10L 19/032* | (2013.01) |

(58) Field of Classification Search
USPC ..... 704/500
See application file for complete search history.

(56) References Cited

U.S. PATENT DOCUMENTS

| | | | | |
|---|---|---|---|---|
| 2009/0240491 | A1* | 9/2009 | Reznik | G10L 19/24 704/219 |
| 2012/0177110 | A1* | 7/2012 | Kleijn | G10L 19/00 375/240.03 |
| 2013/0006647 | A1 | 1/2013 | Suzuki et al. | |
| 2013/0282383 | A1 | 10/2013 | Hedelin et al. | |

FOREIGN PATENT DOCUMENTS

| | | | |
|---|---|---|---|
| KR | 10-2010-0105745 | A | 9/2010 |
| RU | 2 445 718 | C1 | 3/2012 |
| WO | 2011/033103 | A1 | 3/2011 |
| WO | 2011/114933 | A1 | 9/2011 |
| WO | 2012/161675 | A1 | 11/2012 |

OTHER PUBLICATIONS

Oger, M. et al., "Transform Audio Coding with Arithmetic-Coded Scalar Quantization and Model-Based Bit Allocation", IEEE International Conference on Acoutsics, Speech, and Signal Processing, Apr. 2007, pp. IV-545-IV-548.

Series G: Transmission Systems and Media, Digital Systems and Networks, Digital Terminal Equipments-Coding of Analogue Signals by Methods Other than PCM, "Wideband Coding of Speech at Around 16 kbit/s Using Adaptive Multi-Rate Wideband (AMR-WB)", ITU-T Recommendation G.722.2, Jul. 29, 2003, pp. 1-72.

"Information Technology—MPEG Audio Technologies-Part 3: Unified Speech and Audio Coding", ISO/IEC FDIS 23003-3:2011(E), 2011, 284 pages.

Makhoul, J., "Linear Prediction: A Tutorial Review", Proceedings of the IEEE, vol. 63, No. 4, Apr. 1975, pp. 561-580.

Fuchs, G. et al., "Efficient Context Adaptive Entropy Coding for Real-Time Applications", IEEE International Conference, Acoustics, Speech, and Signal Processing, May 2011, pp. 493-496.

Jeong, Y. et al., "Very Low Bit Rate Video Codec Using Rearrangement of DCT Coefficients and Band-Adaptive Preprocessing", IEEE International Conference, Consumer Electronics, 1999, pp. 244-245.

Official Communication issued in corresponding Taiwanese Patent Application No. 102123018, mailed on Jan. 7, 2015.

Official Communication issued in corresponding International Application PCT/EP2013/062809, mailed on Dec. 6, 2013.

Official Communication issued in corresponding Russian Patent Application No. 2015102588, mailed on Jan. 15, 2016.

* cited by examiner

LINEAR PREDICTION BASED AUDIO CODING USING IMPROVED PROBABILITY DISTRIBUTION ESTIMATION

CROSS-REFERENCE TO RELATED APPLICATIONS

This application is a continuation of copending International Application No. PCT/EP2013/062809, filed Jun. 19, 2013, which is incorporated herein by reference in its entirety, and additionally claims priority from U.S. Provisional Application No. 61/665,485, filed Jun. 28, 2012, which is also incorporated herein by reference in its entirety.

BACKGROUND OF THE INVENTION

The present invention is concerned with linear prediction based audio coding and, in particular, linear prediction based audio coding using spectrum coding.

The classical approach for quantization and coding in the frequency domain is to take (overlapping) windows of the signal, perform a time-frequency transform, apply a perceptual model and quantize the individual frequencies with an entropy coder, such as an arithmetic coder [1]. The perceptual model is basically a weighting function which is multiplied onto the spectral lines such that errors in each weighted spectral line has an equal perceptual impact. All weighted lines can thus be quantized with the same accuracy, and the overall accuracy determines the compromise between perceptual quality and bit-consumption.

In AAC and the frequency domain mode of USAC (non-TCX), the perceptual model was defined band-wise such that a group of spectral lines (the spectral band) would have the same weight. These weights are known as scale factors, since they define by what factor the band is scaled. Further, the scale factors were differentially encoded.

In TCX-domain, the weights are not encoded using scale factors, but by an LPC model [2] which defines the spectral envelope, that is the overall shape of the spectrum. The LPC is used because it allows smooth switching between TCX and ACELP. However, the LPC does not correspond well to the perceptual model, which should be much smoother, whereby a process known as weighting is applied to the LPC such that the weighted LPC approximately corresponds to the desired perceptual model.

In the TCX-domain of USAC, spectral lines are encoded by an arithmetic coder. An arithmetic coder is based on assigning probabilities to all possible configurations of the signal, such that high probability values can be encoded with a small number of bits, such that bit-consumption is minimized. To estimate the probability distribution of spectral lines, the codec employs a probability model that predicts the signal distribution based on prior, already coded lines in the time-frequency space. The prior lines are known as the context of the current line to encode [3].

Recently, NTT proposed a method for improving the context of the arithmetic coder (compare [4]). It is based on using the LTP to determine approximate positions of harmonic lines (comp-filter) and rearranging the spectral lines such that magnitude prediction from the context is more efficient.

Generally speaking, the better the probability distribution estimation is, the more efficient the compression achieved by the entropy coding is. It would be favorable to have a concept at hand which would enable the achievement of a probability distribution estimation of similar quality as obtainable using any of the above-outlined techniques, but at a reduced complexity.

SUMMARY

According to an embodiment, a linear prediction based audio decoder may have: a probability distribution estimator configured to determine, for each of a plurality of spectral components, a probability distribution estimation from linear prediction coefficient information contained in a data stream into which an audio signal is encoded; an entropy decoding and dequantization stage configured to entropy decode and dequantize a spectrum composed of the plurality of spectral components from the data stream using the probability distribution estimation as determined for each of the plurality of spectral components; and a filter configured to shape the spectrum according to a transfer function depending on a linear prediction synthesis filter defined by the linear prediction coefficient information, wherein the probability distribution estimator is configured to determine a spectral fine structure from long-term prediction parameters contained in the data stream and determine, for each of the plurality of spectral components, a probability distribution parameter such that the probability distribution parameters spectrally follow a function which multiplicatively depends on the spectral fine structure, wherein, for each of the plurality of spectral components, the probability distribution estimation is a parameterizable function parameterized with the probability distribution parameter of the respective spectral component.

According to another embodiment, a linear prediction based audio encoder may have: a linear prediction analyzer configured to determine linear prediction coefficient information; a probability distribution estimator configured to determine, for each of a plurality of spectral components, a probability distribution estimation from the linear prediction coefficient information; and a spectrum determiner configured to determine a spectrum composed of the plurality of spectral components from an audio signal; a quantization and entropy encoding stage configured to quantize and entropy encode the spectrum using the probability distribution estimation as determined for each of the plurality of spectral components, wherein the spectrum determiner is configured to shape an original spectrum of the audio signal according to a transfer function which depends on an inverse of a linear prediction synthesis filter defined by the linear prediction coefficient information, and wherein the linear prediction based audio encoder further has a long-term predictor configured to determine long-term prediction parameters and the probability distribution estimator is configured to determine a spectral fine structure from the long-term prediction parameters and determine, for each of the plurality of spectral components, a probability distribution parameter such that the probability distribution parameters spectrally follow a function which depends on a product of a transfer function of the linear prediction synthesis filter, an inverse of a transfer function of a perceptually weighted modification of the linear prediction synthesis filter, and the spectral fine structure, wherein, for each of the plurality of spectral components, the probability distribution estimation is a parameterizable function parameterized with the probability distribution parameter of the respective spectral component.

According to still another embodiment, a method for linear prediction based audio decoding may have the steps of: determining, for each of a plurality of spectral components, a probability distribution estimation from linear prediction coefficient information contained in a data stream into which an audio signal is encoded; and entropy decoding and dequantizing a spectrum composed of the plurality of spectral components from the data stream using the probability distribution estimation as determined for each of the plurality of spectral components, the method also having a step of shaping the spectrum according to a transfer function depending on a linear prediction synthesis filter defined by the linear prediction coefficient information, wherein the determination of the probability distribution estimation has a step of determining a spectral fine structure from long-term prediction parameters contained in the data stream and determining, for each of the plurality of spectral components, a probability distribution parameter such that the probability distribution parameters spectrally follow a function which multiplicatively depends on the spectral fine structure, wherein, for each of the plurality of spectral components, the probability distribution estimation is a parameterizable function parameterized with the probability distribution parameter of the respective spectral component.

According to another embodiment, a method for linear prediction based audio encoding may have the steps of: determining linear prediction coefficient information; determining, for each of a plurality of spectral components, a probability distribution estimation from the linear prediction coefficient information; and determining a spectrum composed of the plurality of spectral components from an audio signal; quantizing and entropy encoding the spectrum using the probability distribution estimation as determined for each of the plurality of spectral components, wherein the determination of the spectrum has a step of shaping an original spectrum of the audio signal according to a transfer function which depends on an inverse of a linear prediction synthesis filter defined by the linear prediction coefficient information, and wherein the method further has a step of determining long-term prediction parameters and the determination of the probability distribution has a step of determining a spectral fine structure from the long-term prediction parameters and determining, for each of the plurality of spectral components, a probability distribution parameter such that the probability distribution parameters spectrally follow a function which depends on a product of a transfer function of the linear prediction synthesis filter, an inverse of a transfer function of a perceptually weighted modification of the linear prediction synthesis filter, and the spectral fine structure, wherein, for each of the plurality of spectral components, the probability distribution estimation is a parameterizable function parameterized with the probability distribution parameter of the respective spectral component.

Another embodiment may have a computer program having a program code for performing, when running on a computer, the above methods for linear prediction based audio encoding and decoding.

It is a basic finding of the present invention that linear prediction based audio coding may be improved by coding a spectrum composed of a plurality of spectral components using a probability distribution estimation determined for each of the plurality of spectral components from linear prediction coefficient information. In particular, the linear prediction coefficient information is available anyway. Accordingly, it may be used for determining the probability distribution estimation at both encoding and decoding side. The latter determination may be implemented in a computationally simple manner by using, for example, an appropriate parameterization for the probability distribution estimation at the plurality of spectral components. All together, the coding efficiency as provided by the entropy coding is compatible with probability distribution estimations as achieved using context selection, but its derivation is less complex. For example, the derivation may be purely analytically and/or does not require any information on attributes of neighboring spectral lines such as previously coded/decoded spectral values of neighboring spectral lines as is the case in spatial context selection. This, in turn, renders parallelization of computation processes easier, for example. Moreover, less memory requirements and less memory accesses may be necessitated.

In accordance with an embodiment of the present application, the spectrum, the spectral values of which are entropy coded using the probability estimation determined as just outlined, may be a transform coded excitation obtained using the linear prediction coefficient information.

In accordance with an embodiment of the present application, for example, the spectrum is a transform coded excitation defined, however, in a perceptually weighted domain. That is, the spectrum entropy coded using the determined probability distribution estimation corresponds to an audio signals spectrum pre-filtered using a transform function corresponding to a perceptually weighted linear prediction synthesis filter defined by the linear prediction coefficient information and for each of the plurality of spectral components a plurality distribution parameter is determined such that the probability distribution parameters spectrally follow, e.g. are a scaled version of, a function which depends on a product of a transfer function of the linear prediction synthesis filter and an inverse of a transfer function of the perceptually weighted modification of the linear prediction synthesis filter. For each of the plurality of spectral components, the plurality distribution estimation is then a parameterizable function parameterized with the probability distribution parameter of the respective spectral component. Again, the linear prediction coefficient information is available anyway, and the derivation of the probability distribution parameter may be implemented as a purely analytical process and/or a process which does not require any interdependency between the spectral values at different spectral components of the spectrum.

In accordance with an even further embodiment, the probability distribution parameter is alternatively or additionally determined such that the probability distribution parameters spectrally follow a function which multiplicatively depends on a spectral fine structure which in turn is determined using long term prediction (LTP). Again, in some linear prediction based codecs, LTP information is available anyway and beyond this, the determination of the probability distribution parameters is still feasible to be performed purely analytically and/or without interdependencies between coding of spectral values of different spectral components of the spectrum. When combining the LTP usage with the perceptual transform coded excitation coding, the coding efficiency is further improved at moderate complexity increases.

BRIEF DESCRIPTION OF THE DRAWINGS

Embodiments of the present application are described further below with respect to the figures, among which

FIG. 11 shows a block diagram of a portion within a linear prediction based audio decoder of for example FIGS. 7 and 8 positioned at a portion thereof which corresponds to the portion at which FIG. 10 is located at the encoding side, i.e. located at probability distribution estimator 102 and entropy decoding and dequantization stage 104, in accordance with an embodiment.

DETAILED DESCRIPTION OF THE INVENTION

Figure 1:
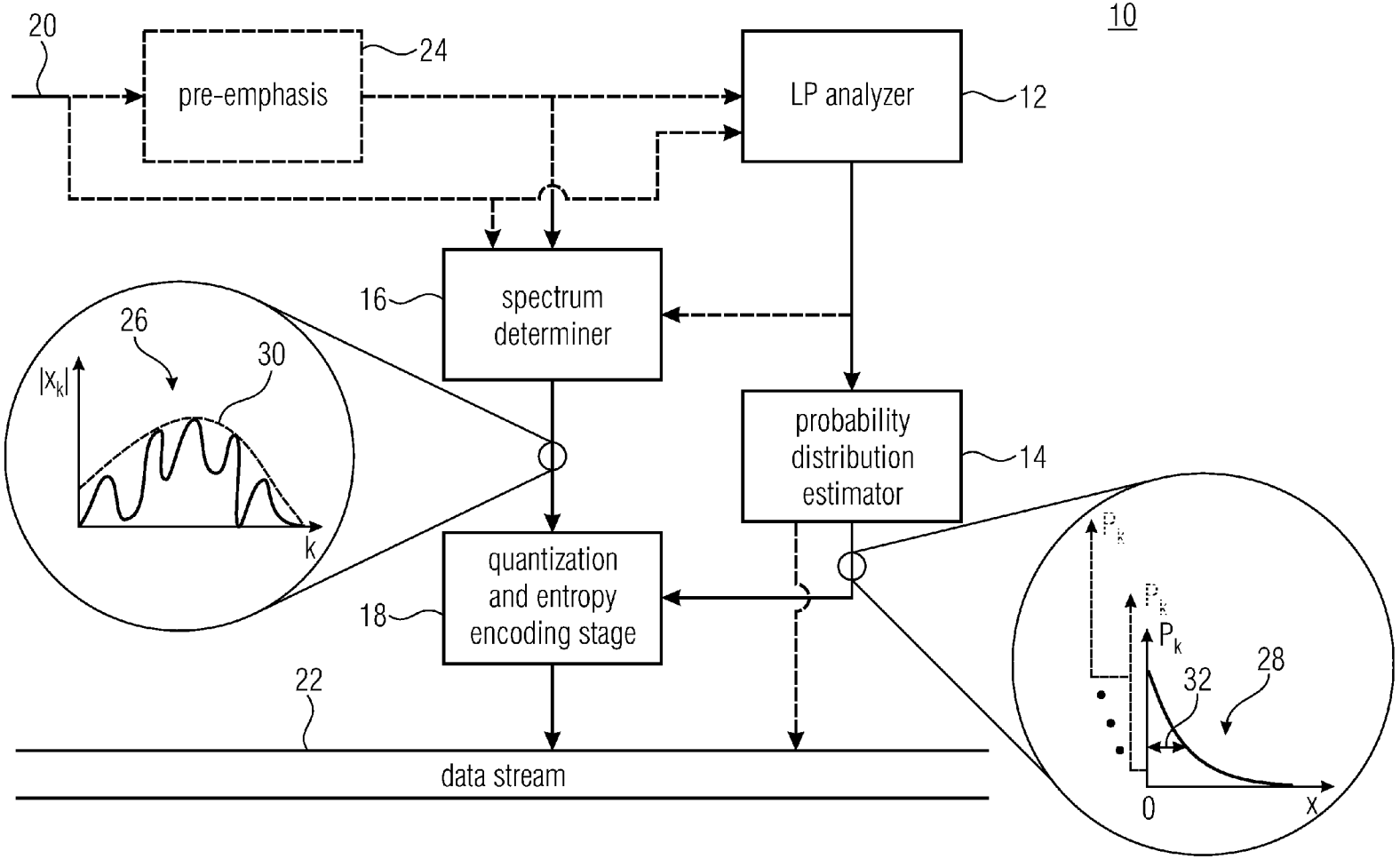
FIG. 1 shows a block diagram of a linear prediction based audio encoder according to an embodiment.

Before describing various embodiments of the present application, the ideas underlying the same are exemplarily discussed against the background indicated in the introductory portion of the specification of the present application. The specific features stemming from the comparison with concrete comparison techniques such as USAC, are not to be treated as restricting the scope of the present application and its embodiments.

In the USAC approach for arithmetic coding, the context basically predicts the magnitude distribution of the following lines. That is, the spectral lines or spectral components are scanned in spectral dimensions while coding/decoding, and the magnitude distribution is predicted continuously depending on the previously coded/decoded spectral values. However, the LPC already encodes the same information explicitly, without the need for prediction. Accordingly, employing the LPC instead of this context should bring a similar result, however at lower computational complexity or at least with the possibility of achieving a lower complexity. In fact, since at low bit-rates the spectrum essentially consists of ones and zeros, the context will often be very sparse and devoid of useful information. Therefore, in theory the LPC should in fact be a much better source for magnitude estimates as the template of neighboring, already coded/decoded spectral values used for probability distribution estimation is merely sparsely populated with useful information. Besides, LPC information is already available at both the encoder and decoder, whereby it comes at zero cost in terms of bit-consumption.

The LPC model only defines the spectral envelope shape, that is the relative magnitudes of each line, but not the absolute magnitude. To define a probability distribution for a single line, we need the absolute magnitude, that is a value for the signal variance (or a similar measure). An essential part of most LPC based spectral quantizer models should accordingly be a scaling of the LPC envelope, such that the desired variance (and thus the desired bit-consumption) is reached. This scaling should usually be performed at both the encoder as well as the decoder since the probability distributions for each line then depend on the scaled LPC.

As described above, the perceptual model (weighted LPC) may be used to define the perceptual model, i.e. quantization may be performed in the perceptual domain such that the expected quantization error at each spectral line causes approximately an equal amount of perceptual distortion. Accordingly, if so, the LPC model is transformed to the perceptual domain as well by multiplying it with the weighted LPC as defined below. In the embodiments described below, it is often assumed that the LPC envelope is transformed to the perceptual domain.

Thus, it is possible to apply an independent probability model for each spectral line. It is reasonable to assume that the spectral lines have no predictable phase correlation, whereby it is sufficient to model the magnitude only. Since the LPC can be presumed to encode the magnitude efficiently, having a context-based arithmetic coder will probably not improve the efficiency of the magnitude estimate.

Accordingly, it is possible to apply a context based entropy coder such that the context depends on, or even consists of, the LPC envelope.

In addition to the LPC envelope, the LTP can also be used to infer envelope information. After all, the LTP may correspond to a comb-filter in the frequency domain. Some practical details are discussed further below.

After having explained some thoughts which led to the idea underlying the embodiments described further below, the description of these embodiments now starts with respect to FIG. 1, which shows an embodiment for a linear prediction based audio encoder according to an embodiment of the present application. The linear prediction based audio encoder of FIG. 1 is generally indicated using reference sign 10 and comprises a linear prediction analyzer 12, a probability distribution estimation 14, a spectrum determiner 16 and a quantization and entropy encoding stage 18. The linear prediction based audio encoder 10 of FIG. 1 receives an audio signal to be encoded at, for example, an input 20, and outputs a data stream 22, which accordingly has the audio signal encoded therein. LP analyzer 12 and spectrum determiner 16 are, as shown in FIG. 1, either directly or indirectly coupled with input 20. The probability distribution estimator 14 is coupled between the LP analyzer 12 and the quantization and entropy encoding stage 18 and the quantization and entropy encoding stage 18, in turn, is coupled to an output of spectrum determiner 16. As can be seen in FIG. 1, LP analyzer 12 and quantization and entropy encoding stage 18 contribute to the formation/generation of data stream 22. As will be described in more detail below, encoder 10 may optionally comprise a pre-emphasis filter 24 which may be coupled between input 20 and LP analyzer 12 and/or spectrum determiner 16. Further, the spectrum determiner 16 may optionally be coupled to the output of LP analyzer 12.

In particular, the LP analyzer 12 is configured to determine linear prediction coefficient information based on the audio signal inbound at input 20. As depicted in FIG. 1, the LP analyzer 12 may either perform linear prediction analysis on the audio signal at input 20 directly or on some modified version thereof, such as for example a pre-emphasized version thereof as obtained by pre-emphasis filter 24. The mode of operation of LP analyzer 12 may, for example, involve a windowing of the inbound signal so as to obtain a sequence of windowed portions of the signal to be LP analyzed, an autocorrelation determination so as to determine the autocorrelation of each windowed portion and lag windowing, which is optional, for applying a lag window function onto the autocorrelations. Linear prediction parameter estimation may then be performed onto the autocorrelations or the lag window output, i.e. windowed autocorrelation functions. The linear prediction parameter estimation may, for example, involve the performance of a Wiener-Levinson-Durbin or other suitable algorithm onto the (lag windowed) autocorrelations so as to derive linear prediction coefficients per autocorrelation, i.e. per windowed portion of the signal to be LP analyzed. That is, at the output of LP analyzer 12, LPC coefficients result which are, as described further below, used by the probability distribution estimator 14 and, optionally, the spectrum determiner 16. The LP analyzer 12 may be configured to quantize the linear prediction coefficient for insertion into the data stream 22. The quantization of the linear prediction coefficients may be performed in another domain than the linear prediction coefficient domain such as, for example, in a line spectral pair or line spectral frequency domain. The quantized linear prediction coefficients may be coded into the data stream 22. The linear prediction coefficient information actually used by the probability distribution estimator 14 and, optionally, the spectrum determiner 16 may take into account the quantization loss, i.e. may be the quantized version which is losslessly transmitted via data stream. That is, the latter may actually use as the linear prediction coefficient information the quantized linear prediction coefficients as obtained by linear prediction analyzer 12. Merely for the sake of completeness, it is noted that there exist a huge amount of possibilities of performing the linear prediction coefficient information determination by linear prediction analyzer 12. For example, other algorithms than a Wiener-Levinson-Durbin algorithm may be used. Moreover, an estimate of the local autocorrelation of the signal to be LP analyzed may be obtained based on a spectral decomposition of the signal to be LP analyzed. In WO 2012/110476 A1, for example, it is described that the autocorrelation may be obtained by windowing the signal to be LP analyzed, subjecting each windowed portion to an MDCT, determining the power spectrum per MDCT spectrum and performing an inverse ODFT for transitioning from the MDCT domain to an estimate of the autocorrelation. To summarize, the LP analyzer 12 provides linear prediction coefficient information and the data stream 22 conveys or comprises this linear prediction coefficient information. For example, the data stream 22 conveys the linear prediction coefficient information at the temporal resolution which is determined by the just mentioned windowed portion rate, wherein the windowed portions may, as known in the art, overlap each other, such as for example at a 50% overlap.

As far as the pre-emphasis filter 24 is concerned, it is noted that same may, for example, be implemented using FIR filtering. The pre-emphasis filter 24 may, for example, have a high pass transfer function. In accordance with an embodiment, the pre-emphasis filter 24 is embodied as an n-th order high pass filter, such as, for example, $H(z)=1-\alpha z^{-1}$ with a being set, for example, to 0.68.

The spectrum determiner is described next. The spectrum determiner 16 is configured to determine a spectrum composed of a plurality of spectral components based on the audio signal at input 20. The spectrum is to describe the audio signal. Similar to linear prediction analyzer 12, spectrum determiner 16 may operate on the audio signal 20 directly, or onto some modified version thereof, such as for example the pre-emphasis filtered version thereof. The spectrum determiner 16 may use any transform in order to determine the spectrum such as, for example, a lapped transform or even a critically sampled lapped transform, such as for example, an MDCT although other possibilities exist as well. That is, spectrum determiner 16 may subject the signal to be spectrally decomposed to windowing so as to obtain a sequence of windowed portions and subject each windowed portion to a respective transformation such as an MDCT. The windowed portion rate of spectrum determiner 16, i.e. the temporal resolution of the spectral decomposition, may differ from the temporal resolution at which LP analyzer 12 determines the linear prediction coefficient information.

Spectrum determiner 16 thus outputs a spectrum composed of a plurality of spectral components. In particular, spectrum determiner 16 may output, per windowed portion which is subject to a transformation, a sequence of spectral values, namely one spectral value per spectral component, e.g. per spectral line of frequency. The spectral values may be complex valued or real valued. The spectral values are real valued in case of using an MDCT, for example. In particular, the spectral values may be signed, i.e. same may be a combination of sign and magnitude.

As denoted above, the linear prediction coefficient information forms a short term prediction of the spectral envelope of the LP analyzed signal and may, thus, serve as a basis for determining, for each of the plurality of spectral components, a probability distribution estimation, i.e. an estimation of how, statistically, the probability that the spectrum at the respective spectral component, assumes a certain possible spectral value, varies over the domain of possible spectral values. The determination is performed by probability distribution estimator 14. Different possibilities exist with regard to the details of the determination of the probability distribution estimation. For example, although the spectrum determiner 16 could be implemented to determine the spectrogram of the audio signal or the pre-emphasized version of the audio signal, in accordance with the embodiments further outlined below, the spectrum determiner 16 is configured to determine, as the spectrum, an excitation signal, i.e. a residual signal obtained by LP-based filtering the audio signal or some modified version thereof, such as the per-emphasis filtered version thereof. In particular, the spectrum determiner 16 may be configured to determine the spectrum of the signal inbound to spectrum determiner 16, after filtering the inbound signal using a transfer function which depends on, or is equal to, an inverse of a linear prediction synthesis filter defined by the linear prediction coefficient information, i.e. the linear prediction analysis filter. Alternatively, the LP-based audio encoder may be a perceptual LP-based audio encoder and the spectrum determiner 16 may be configured to determine the spectrum of the signal inbound to spectrum determiner 16, after filtering the inbound signal using a transfer function which depends on, or is equal to, an inverse of a linear prediction synthesis filter defined by the linear prediction coefficient information, but has been modified so as to, for example, correspond to the inverse of an estimation of a masking threshold. That is, spectrum determiner 16 could be configured to determine the spectrum of the signal inbound, filtered with a transfer function which corresponds to the inverse of a perceptually modified linear prediction synthesis filter. In that case, the spectrum determiner 16 comparatively reduces the spectrum at spectral regions where the perceptual masking is higher relative to spectral regions where the perceptual masking is lower. By use of the linear prediction coefficient information, the probability distribution estimator 14 is, however, still able to estimate the envelope of the spectrum determined by spectrum determiner 16, namely by taking the perceptual modification of the linear prediction synthesis filter into account when determining the probability distribution estimation. Details in this regard are further outlined below.

Further, as outlined in more detail below, the probability distribution estimator 14 is able to use long term prediction in order to obtain a fine structure information on the spectrum so as to obtain a better probability distribution estimation per spectral component. LTP parameter(s) is/are sent, for example, to the decoding so as to enable a reconstruction of the fine structure information. Details in this regard are described further below.

In any case, the quantization and entropy encoding stage 18 is configured to quantize and entropy encode the spectrum using the probability distribution estimation as determined for each of the plurality of spectral components by probability distribution estimator 14. To be more precise, quantization and entropy encoding stage 18 receives from spectral determiner 16 a spectrum 26 composed of spectral components k, or to be more precise, a sequence of spectrums 26 at some temporal rate corresponding to the aforementioned windowed portion rate of windowed portions subject to transformation. In particular, stage 18 may receive a sign value per spectral value at spectral component k and a corresponding magnitude $|x_k|$ per spectral component k.

On the other hand, quantization and entropy encoding stage 18 receives, per spectral component k, a probability distribution estimation 28 defining, for each possible value the spectral value may assume, a probability value estimate determining the probability of the spectral value at the respective spectral component k having this very possible value. For example, the probability distribution estimation determined by probability distribution estimator 14 concentrates on the magnitudes of the spectral values only and determines, accordingly, probability values for positive values including zero, only. In particular, the quantization and entropy encoding stage 18 quantizes the spectral values, for example, using a quantization rule which is equal for all spectral components. The magnitude levels for the spectral components k, thus obtained, are accordingly defined over a domain of integers including zero up to, optionally, some maximum value. The probability distribution estimation could, for each spectral component k, be defined over this domain of possible integers i, i.e. p(k, i) would be the probability estimation for spectral component k and be defined over integer $i \in [0;\max]$ with integer $k \in [0;k_{max}]$ with $k_{max}$ being the maximum spectral component and $p(k;i) \in [0;1]$ for all k,i and the sum over p(k,i) over all $i \in [0;\max]$ being one for all k.

The quantization and entropy encoding stage 18 may, for example, use a constant quantization step size for the quantization with the step size being equal for all spectral components k. The better the probability distribution estimation 28 is, the better is the compression efficiency achieved by quantization and entropy encoding stage 18.

Frankly speaking, the probability distribution estimator 14 may use the linear prediction coefficient information provided by LP analyzer 12 so as to gain an information on an envelope 30, or approximate shape, of spectrum 26. Using this estimate 30 of the envelope or shape, estimator 14 may derive a dispersion measure 32 for each spectral component k by, for example, appropriately scaling, using a common scale factor equal for all spectral components, the envelope. These dispersion measures at spectral components k may serve as parameters for parameterizations of the probability distribution estimations for each spectral component k. For example, p(k,i) may be f(i,l(k)) for all k with l(i) being the determined dispersion measure at spectral component k, with f(i,l) being, for each fixed l, an appropriate function of variable i such as a monotonic function such as, as defined below, a Gaussian or Laplace function defined for positive values i including zero, while l is function parameter which measures the "steepness" or "broadness" of the function as will be outlined below in more precise wording. Using the parameterized parameterizations, quantization and entropy encoding stage 18 is thus able to efficiently entropy encode the spectral values of the spectrum into data stream 22. As will become clear from the description brought forward below in more detail, the determination of the probability distribution estimation 28 may be implemented purely analytically and/or without requiring interdependencies between spectral values of different spectral components of the same spectrum 26, i.e. independent from spectral values of different spectral components relating to the same time instant. Quantization and entropy encoding stage 18 could accordingly perform the entropy coding of the quantized spectral values or magnitude levels, respectively, in parallel. The actual entropy coding may in turn be an arithmetic coding or a variable length coding or some other form of entropy coding such as probability interval partitioning entropy coding or the like. In effect, quantization and entropy encoding stage 18 entropy encodes each spectral value at a certain spectral component k using the probability distribution estimation 28 for that spectral component k so that a bit-consumption for a respective spectral value k for its coding into data stream 22 is lower within portions of the domain of possible values of the spectral value at the spectral component k where the probability indicated by the probability distribution estimation 28 is higher, and the bit-consumption is greater at portions of the domain of possible values where the probability indicated by probability distribution estimation 28 is lower. In case of arithmetic coding, for example, table-based arithmetic coding may be used. In case of variable length coding, different codeword tables mapping the possible values onto codewords may be selected and applied by the quantization and entropy encoding stage depending on the probability distribution estimation 28 determined by probability distribution estimator 14 for the respective spectral component k.

Figure 2:
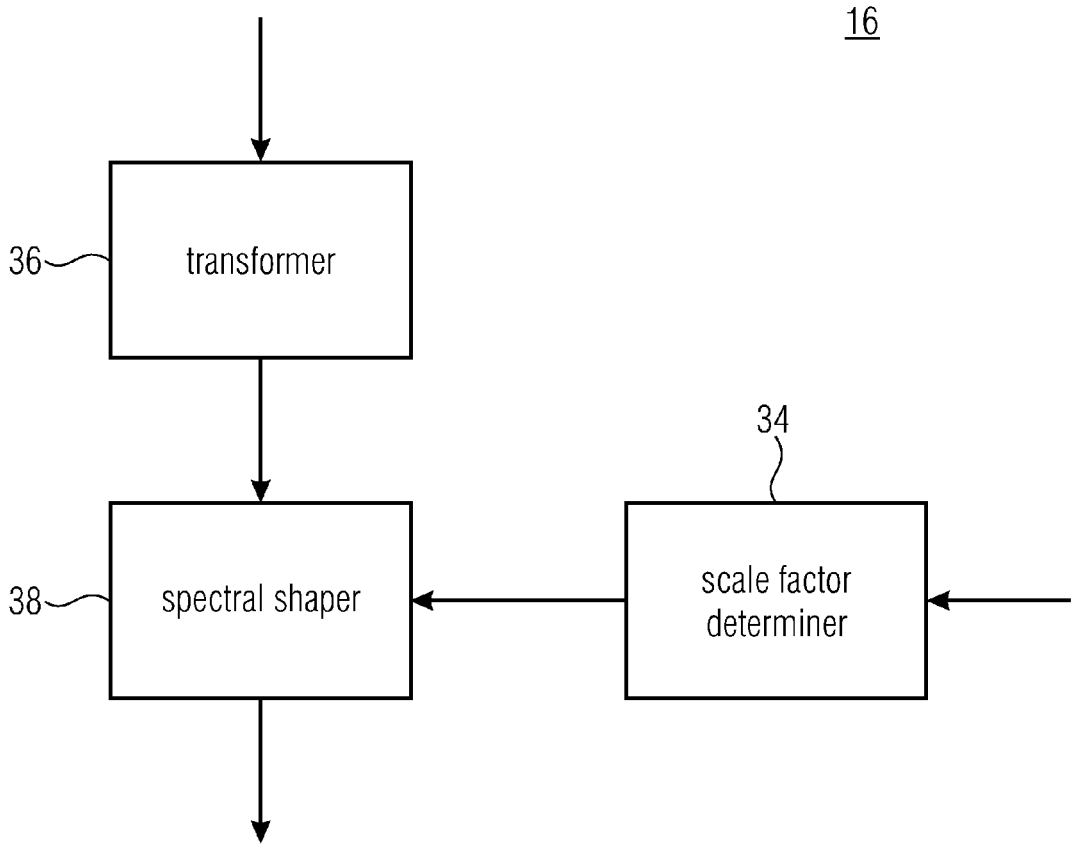
FIG. 2 shows a block diagram of a spectrum determiner of FIG. 1 in accordance with an embodiment.

FIG. 2 shows a possible implementation of the spectrum determiner 16 of FIG. 1. According to FIG. 2, the spectrum determiner 16 comprises a scale factor determiner 34, a transformer 36 and a spectral shaper 38. Transformer 36 and spectral shaper 38 are serially connected to each other between in the input and output of spectral determiner 16 via which spectral determiner 16 is connected between input 20 and quantization and entropy encoding stage 18 in FIG. 1. The scale factor determiner 34 is, in turn, connected between LP analyzer 12 and a further input of spectral shaper 38 (see FIG. 1).

The scale factor determiner 34 is configured to use the linear prediction coefficient information so as to determine scale factors. The transformer 36 spectrally decomposes the signal same receives, to obtain an original spectrum. As outlined above, the inbound signal may be the original audio signal at input 20 or, for example, a pre-emphasized version thereof. As also already outlined above, transformer 36 may internally subject the signal to be transformed to windowing, portion-wise, using overlapping portions, while individually transforming each windowed portion. As already denoted above, an MDCT may be used for the transformation. That is, transformer 36 outputs one spectral value $x'_k$ per spectral component k and the spectral shaper 38 is configured to spectrally shape this original spectrum by scaling the spectrum using the scale factors, i.e. by scaling each original spectral value $x'_k$ using the scale factors $s_k$ output by scale factor determiner 34 so as to obtain a respective spectral value $x_k$, which is then subject to quantization and entropy encoding in state 18 of FIG. 1.

The spectral resolution at which scale factor determiner 34 determines the scale factors does not necessarily coincide with the resolution defined by the spectral component k. For example, a perceptually motivated grouping of spectral components into spectral groups such as bark bands may form the spectral resolution at which the scale factors, i.e. the spectral weights by which the spectral values of the spectrum output by the transformer 36 are weighted, are determined.

The scale factor determiner 34 is configured to determine the scale factors such that same represent, or approximate, a transfer function which depends on an inverse of a linear prediction synthesis filter defined by the linear prediction coefficient information. For example, the scale factor determiner 34 may be configured to use the linear prediction coefficients as obtained from LP analyzer 12 in, for example, their quantized form in which they are also available at the decoding side via data stream 22, as a basis for an LPC to MDCT conversion which, in turn, may involve an ODFT. Naturally, alternatives exist as well. In case of the above outlined alternatives where the audio encoder of FIG. 1 is a perceptual linear prediction based audio encoder, the scale factor determiner 34 may be configured to perform a perceptually motivated weighting of the LPCs first before performing the conversion to spectral factors using, for example, an ODFT. However, other possibility may exist as well. As will be outlined in more detail below, the transfer function of the filtering resulting from the spectral scaling by spectral shaper 38 may depend, via the scale factor determination performed by scale factor determiner 34, on the inverse of the linear prediction synthesis filter 1/A(z) defined by the linear prediction coefficient information such that the transfer function is an inverse of a transfer function of 1/A(k·z), where k here denotes a constant which may, for example, be 0.92.

Figure 3A:
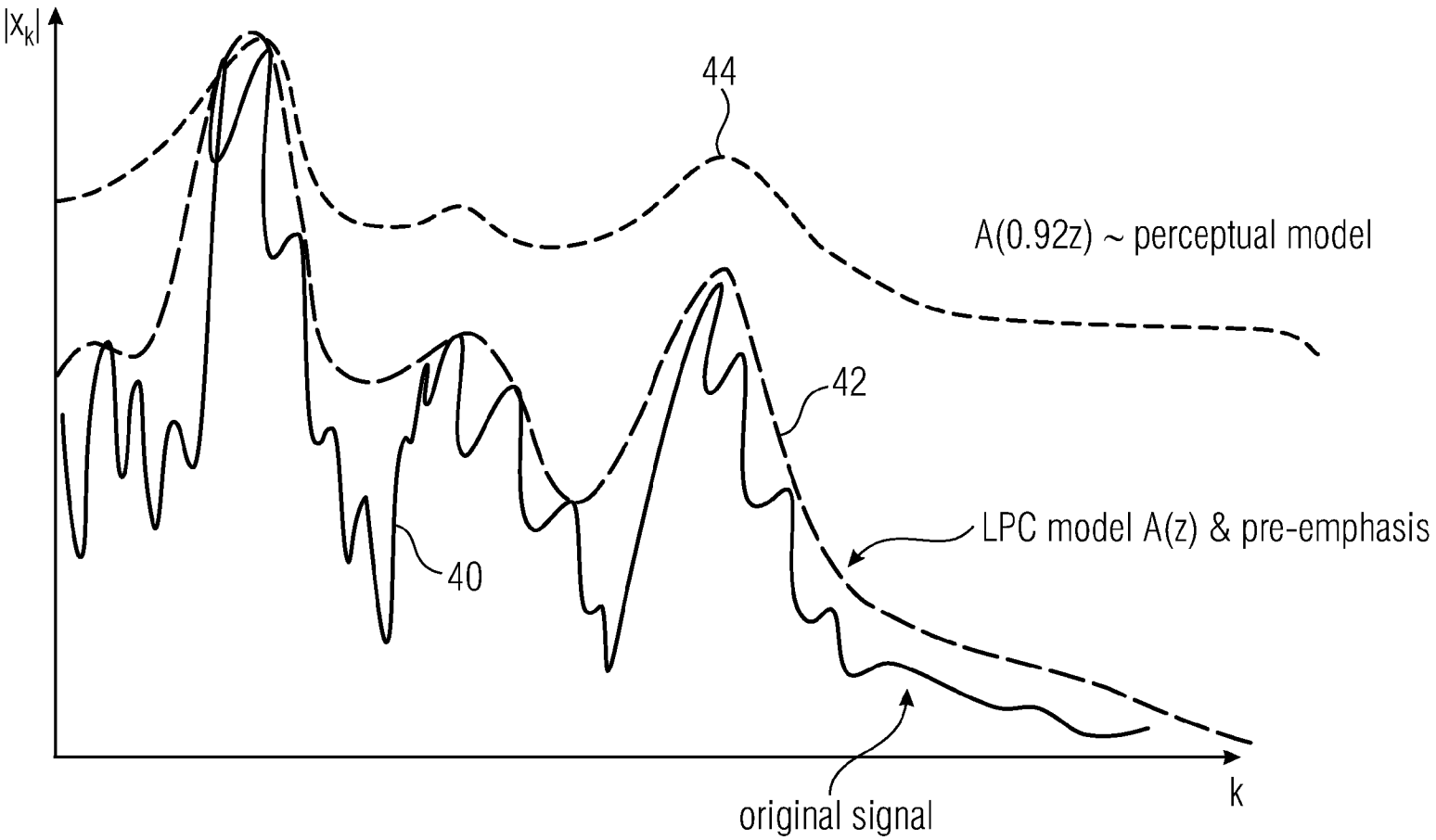
FIG. 3*a* shows different transfer functions occurring in the description of the mode of operation of the elements shown in FIGS. 1 and 2 when implementing same using perceptual coding.
Figure 3B:
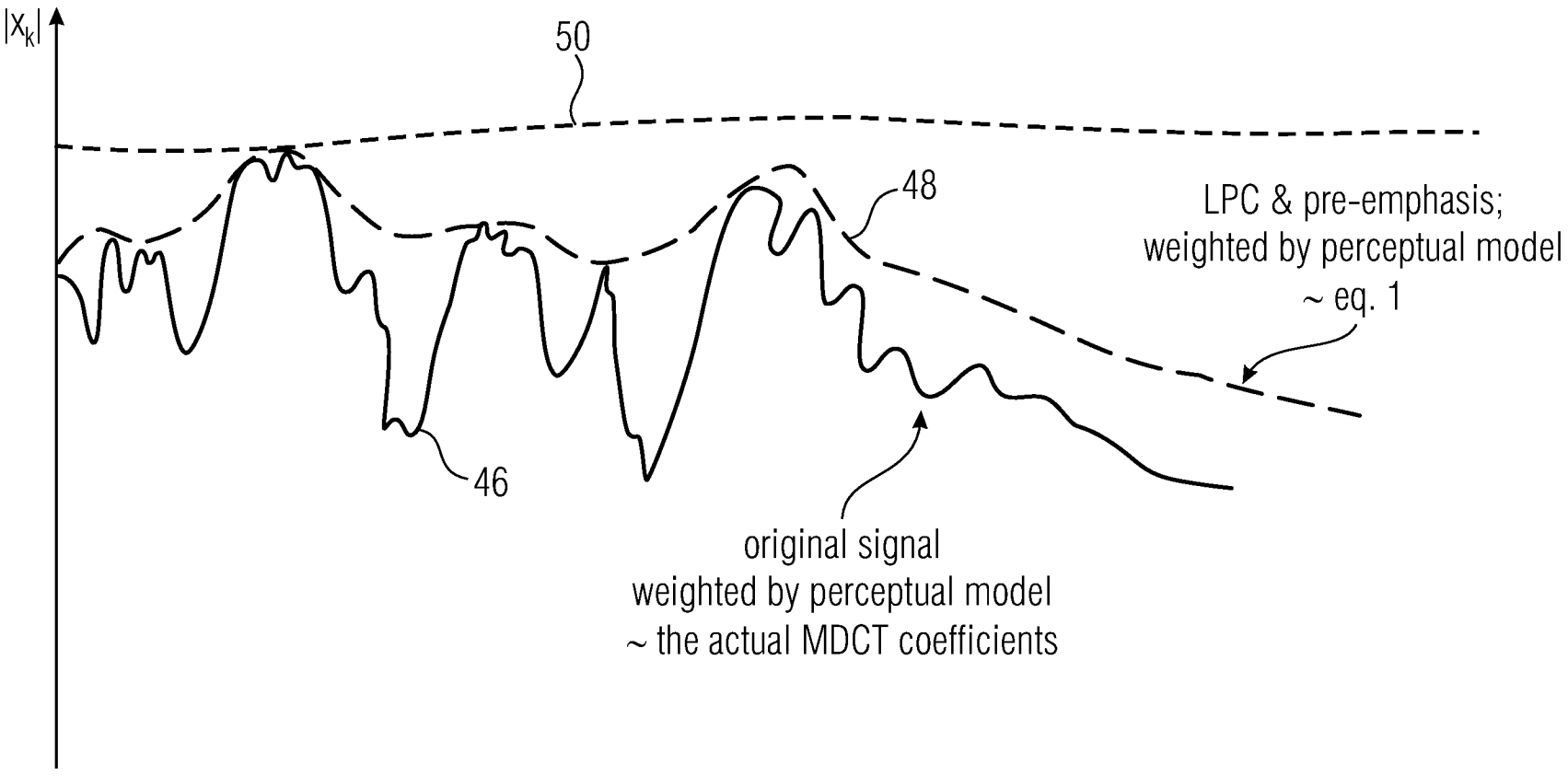
FIG. 3*b* shows the functions of FIG. 3*a* weighted, however, using the inverse of the perceptual model.

In order to better understand the mutual relationship between the functionality of the spectrum determiner on the one hand and probability distribution estimator 14 on the other hand and the way this relationship leads to the effective operation of quantization and entropy encoding stage 18 in the case of the linear prediction based audio encoder acting as a perceptual linear prediction based audio encoder, reference is made to FIGS. 3*a* and 3*b*. FIG. 3*a* shows an original spectrum 40. Here, it is exemplarily the audio signal's spectrum weighted by the pre-emphasis filter's transfer function. To be more precise, FIG. 3*a* shows the magnitude of the spectrum 40 plotted over spectral components or spectral lines k. In the same graph, FIG. 3*a* shows the transfer function of the linear prediction synthesis filter A(z) times the pre-emphasis filter's 24 transfer function, the resulting product being denoted 42. As can be seen, the function 42 approximates the envelope or coarse shape of spectrum 40. In FIG. 3*a*, the perceptually motivated modification of the linear prediction synthesis filter is shown, such as A(0.92 z) in the exemplary case mentioned above. This "perceptual model" is denoted by reference sign 44. Function 44 thus represents a simplified estimation of a masking threshold of the audio signal by taking into account at least spectral occlusions. Spectral factor determiner 34 determines the scale factors so as approximate the inverse of perceptual model 44. The result of multiplying functions 40 to 44 of FIG. 3*a* with the inverse of perceptual model 44 is shown in FIG. 3*b*. For example, 46 shows the result of multiplying spectrum 40 with the inverse of 44 and thus corresponds to the perceptually weighted spectrum as output by spectral shaper 38 in case of encoder 10 acting as a perceptual linear prediction based encoder as described above. As multiplying function 44 with the inverse of the same results in a constant function, the resulting product is depicted as being flat in FIG. 3*b*, see 50.

Now turning to probability distribution estimator 14, same also has access to the linear prediction coefficient information as described above. Estimator 14 is thus able to compute function 48 resulting from multiplying function 42 with the inverse of function 44. This function 48 may serve, as is visible from FIG. 3*b*, as an estimate of the envelope or coarse shape of the pre-filtered 46 as output by spectral shaper 38.

Figure 4:
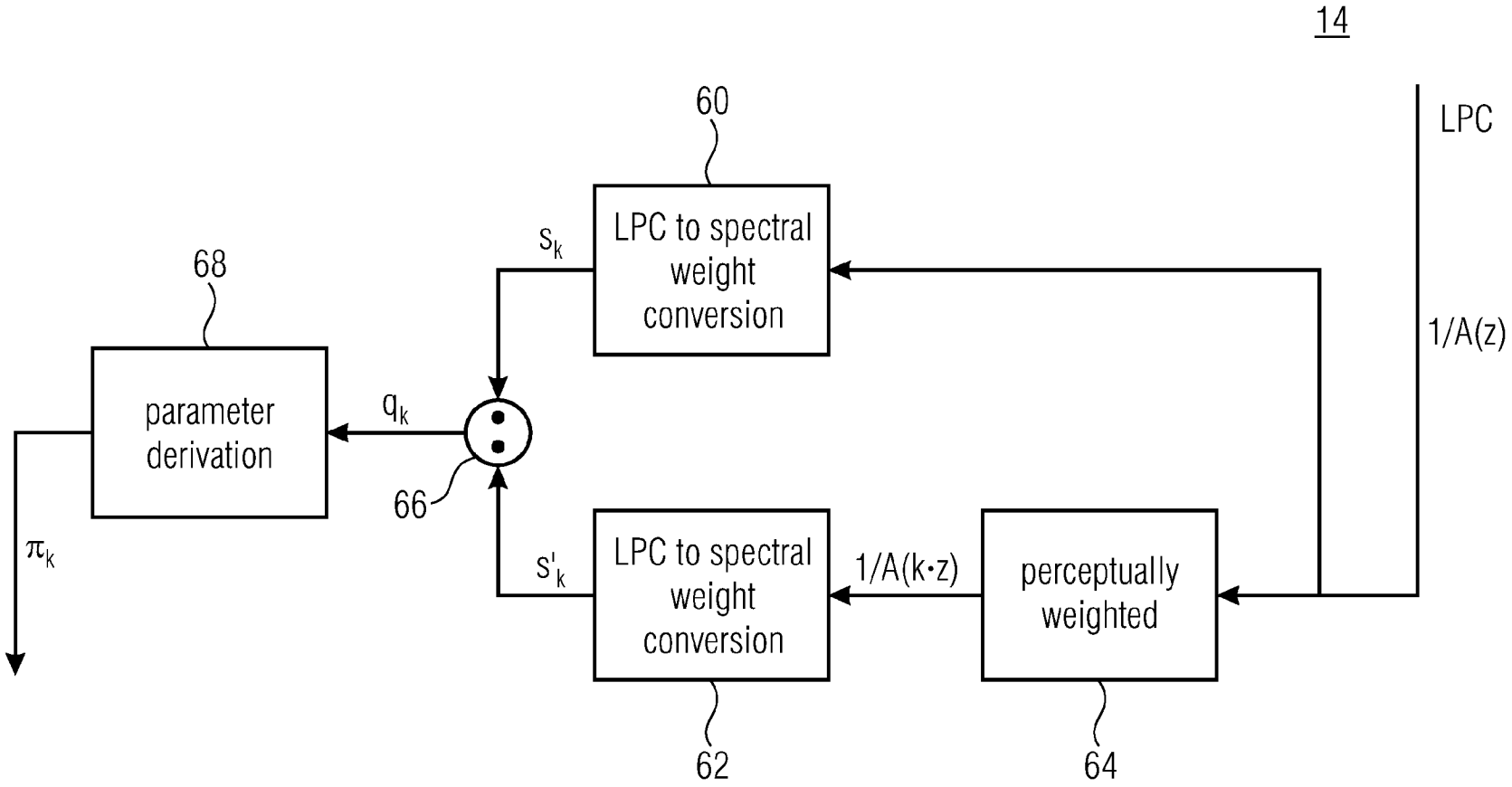
FIG. 4 shows a block diagram illustrating the internal operation of probability distribution estimator 14 of FIG. 1 in accordance with an embodiment using perceptual coding.

Accordingly, the probability distribution estimator 14 could operate as illustrated in FIG. 4. In particular, the probability distribution estimator 14 could subject the linear prediction coefficients defining the linear prediction synthesis filter 1/A(z) to a perceptual weighting 64 so that same corresponds to a perceptually modified linear prediction synthesis filter 1/A(k·z). Both, the unweighted linear prediction coefficients as well as the weighted ones are subject to LPC to spectral weight conversion 60 and 62, respectively, and the result is subject to, per spectral component k, division. The resulting quotient is optionally subject to some parameter derivation 68 where the quotients for the spectral components k are individually, i.e. for each k, subject to some mapping function so as to result in a probability distribution parameter representing a measure, for example, for the dispersion of the probability distribution estimation. To be more precise, the LPC to spectral weight conversions 60, 62 applied to the unweighted and weighted linear prediction coefficients result in spectral weights $s_k$ and $s'_k$ for the spectral components k. The conversions 60, 62 may, as already denoted above, be performed at a lower spectral resolution than the spectral resolution defined by the spectral components k themselves, but interpolation may, for example, be used to smoothen the resulting quotient $q_k$ over the spectral component k. The parameter derivation then results in a probability distribution parameter $\pi_k$ per spectral component k by, for example, scaling all $q_k$ using a scaling factor common for all k. The quantization and entropy encoding stage 18 may then use these probability distribution parameters $\pi_k$ to efficiently entropy encode the spectrally shaped spectrum of the quantization. In particular, as $\pi_k$ is a measure for a dispersion of the probability distribution estimation of envelope spectrum value $x_k$ or at least its magnitude, a parameterizable function, such as the afore mentioned f(i,l(k)), may be used by quantization and entropy encoding stage 18 to determine, for each spectral component k, the probability distribution estimation 28 by using $\pi_k$ as a setting for the parameterizable function, i.e. as l(k). Advantageously, the parameterization of the parameterizable function is such that the probability distribution parameter, e.g. l(k), is actually a measure for a dispersion of the probability distribution estimation, i.e. the probability distribution parameter measures a width of the probability distribution parameterizable function. In a specific embodiment outlined further below, a Laplace distribution is used as the parameterizable function, e.g. f(i,l(k)).

With regard to FIG. 1, it is noted that probability distribution estimator 14 may additionally insert information into the data stream 22 which enables the decoding side to increase the quality of the probability distribution estimation 28 for the individual spectral components k compared to the quality solely provided based on the LPC information. In particular, in accordance with these specific exemplarily described implementation details further outlined below, probability distribution estimator 14 may use long term prediction in order to obtain a spectrally finer estimation 30 of the envelope or shape of spectrum 26 in case of the spectrum 26 representing a transform coded excitation such as the spectrum resulting from filtering with a transform function corresponding to an inverse of the perceptual model or the inverse of the linear prediction synthesis filter.

Figures 5A, 5B, 5C:
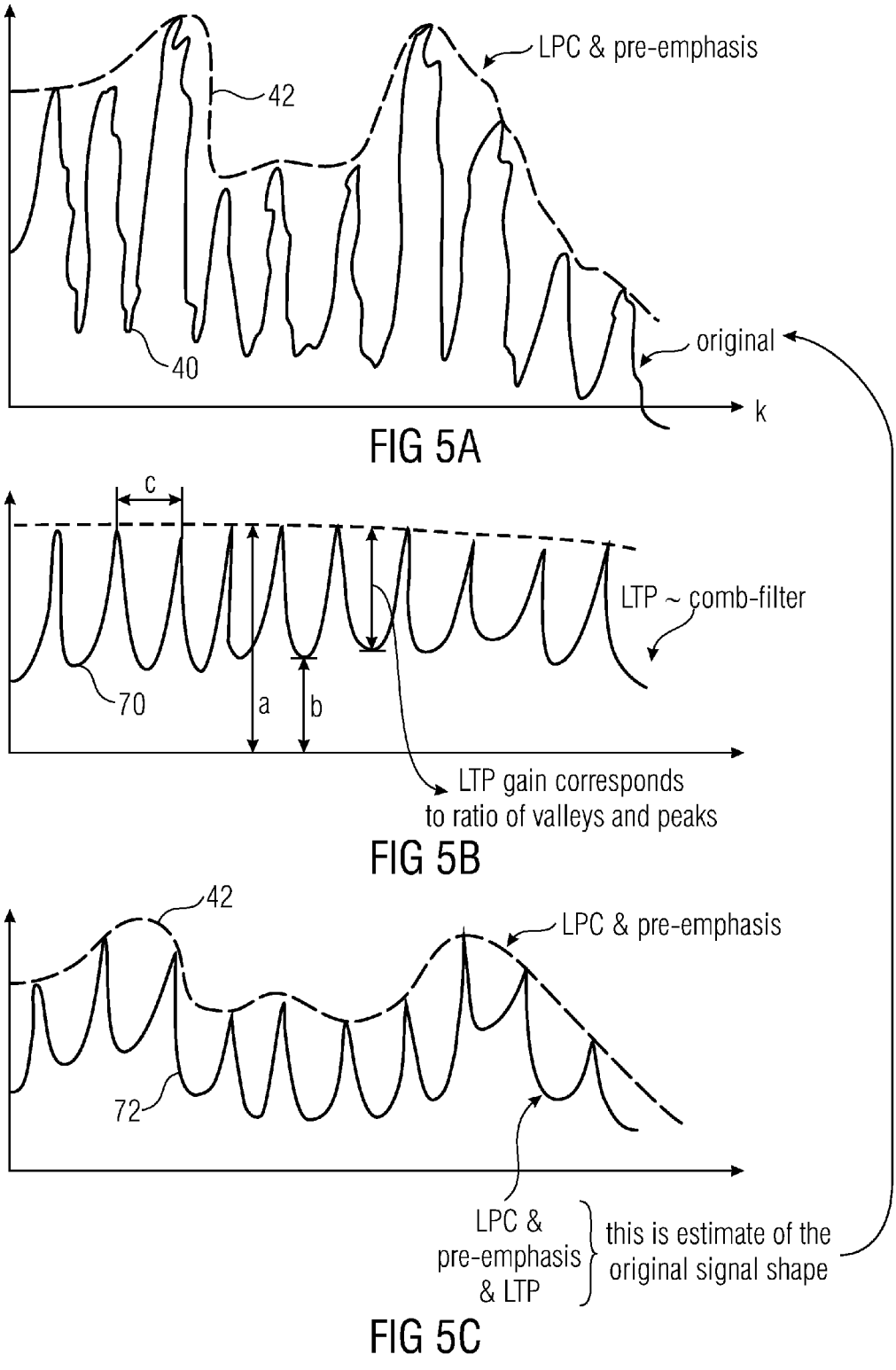
FIG. 5*a* shows a graph illustrating an original audio signal after pre-emphasis filtering and its estimated envelope.
FIG. 5*b* shows an example for an LTP function used to more closely estimate the envelope in accordance with an embodiment.
FIG. 5*c* shows a graph illustrating the result of the envelope estimation by applying the LTP function of FIG. 5*b* to the example of FIG. 5*a;*

For example, see FIGS. 5*a* to 5*c* to illustrate the latter, optional functionality of probability distribution estimator 14. FIG. 5*a* shows, like FIG. 3*a*, the original audio signals spectrum 40 and the LPC model A(z) including the pre-emphasis. That is, we have the original signal 40 and its LPC envelope 42 including pre-emphasis. FIG. 5*b* displays, as an example of the output of the LTP analysis performed by probability distribution estimator 14, an LTP comb-filter 70, i.e. a comb-function over spectral components k parameterized, for example, by a value LTP gain describing the valley-to-peak ratio a/b and a parameter LTP lag defining the pitch or distance between the peaks of the comb function 70, i.e. c. The probability distribution estimator 14 may determine the just mentioned LTP parameters so that multiplying the LTP comb function 70 with the linear prediction coefficient based estimation 30 of spectrum 26 more closely estimates the actual spectrum 26. Multiplying the LTP comb function 70 with the LPC model 42 is exemplarily shown in FIG. 5*c* and it can be seen that the product 72 of LTP comb function 70 and LPC model 42 more closely approximates the actual shape of spectrum 40.

Figure 6:
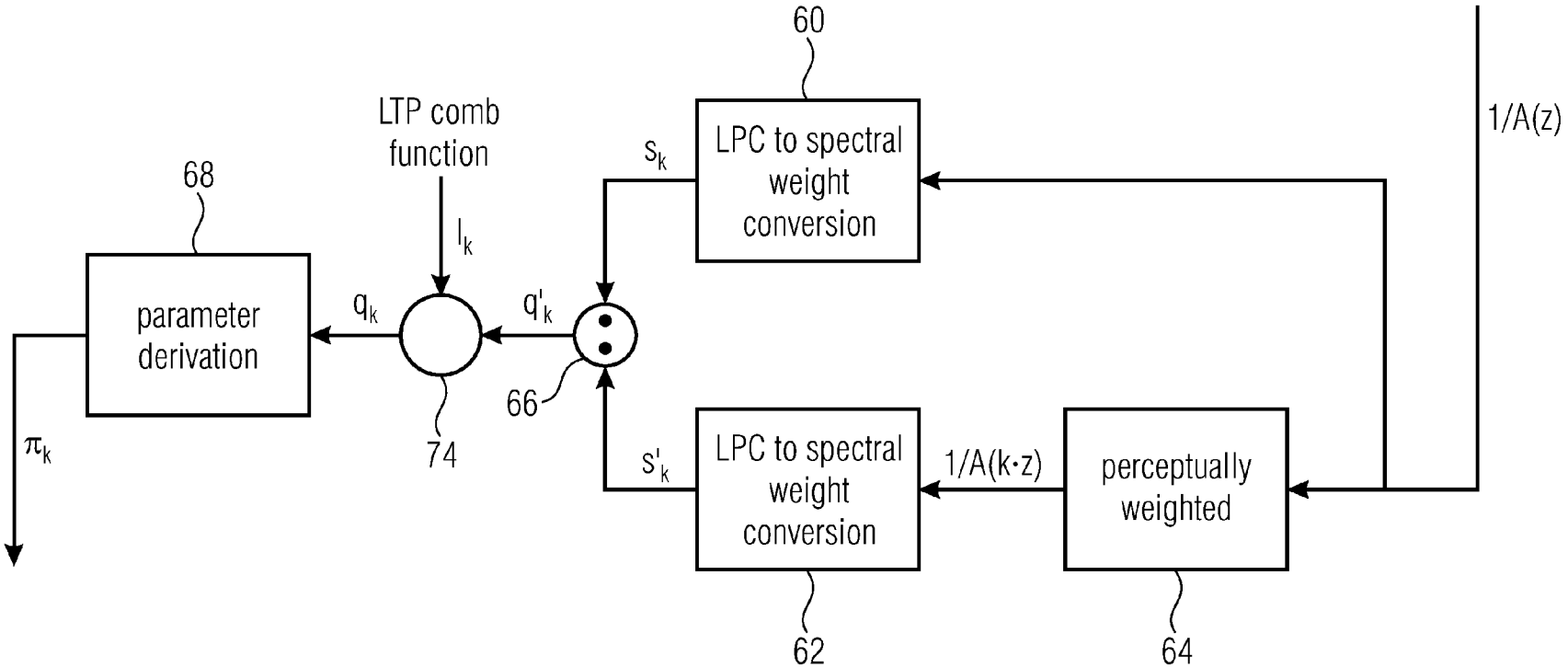
FIG. 6 shows a block diagram of the internal operation of probability distribution estimator 14 in a further embodiment using perceptual coding as well as LTP processing.

In case of combining the LTP functionality of probability distribution estimator 14 with the use of the perceptual domain, the probability distribution estimator 14 may operate as shown in FIG. 6. The mode of operation largely coincides with the one shown in FIG. 4. That is, the LPC coefficients defining the linear prediction synthesis filter 1/A(z) are subject to LPC to spectral weight conversion 60 and 62, namely one time directly and the other time after being perceptually weighted 64. The resulting scale factors are subject to division 66 and the resulting quotients $q_k$ are multiplied using multiplier 47 with the LTP comb function 70, the parameters LTP gain and LTP lag of which are determined by probability distribution estimator 14 appropriately and inserted into the data stream 22 for access for the decoding side. The resulting product $l_k$-$q_k$ with $l_k$ denoting the LTP comb function at spectral component k, is then subject to the probability distribution parameter derivation 68 so as to result in the probability distribution parameters $\pi_k$. Please note that in the following description of the decoding side, reference is made to, inter alias, FIG. 6 with respect to the decoder side's functionality of the probability distribution estimation. In this regard, please note that, at the encoder side, the LTP parameter(s) are determined by way of optimization are the like and inserted into the data stream 22, while the decoding side merely has to read the LTP parameters from the data stream.

Figure 7:
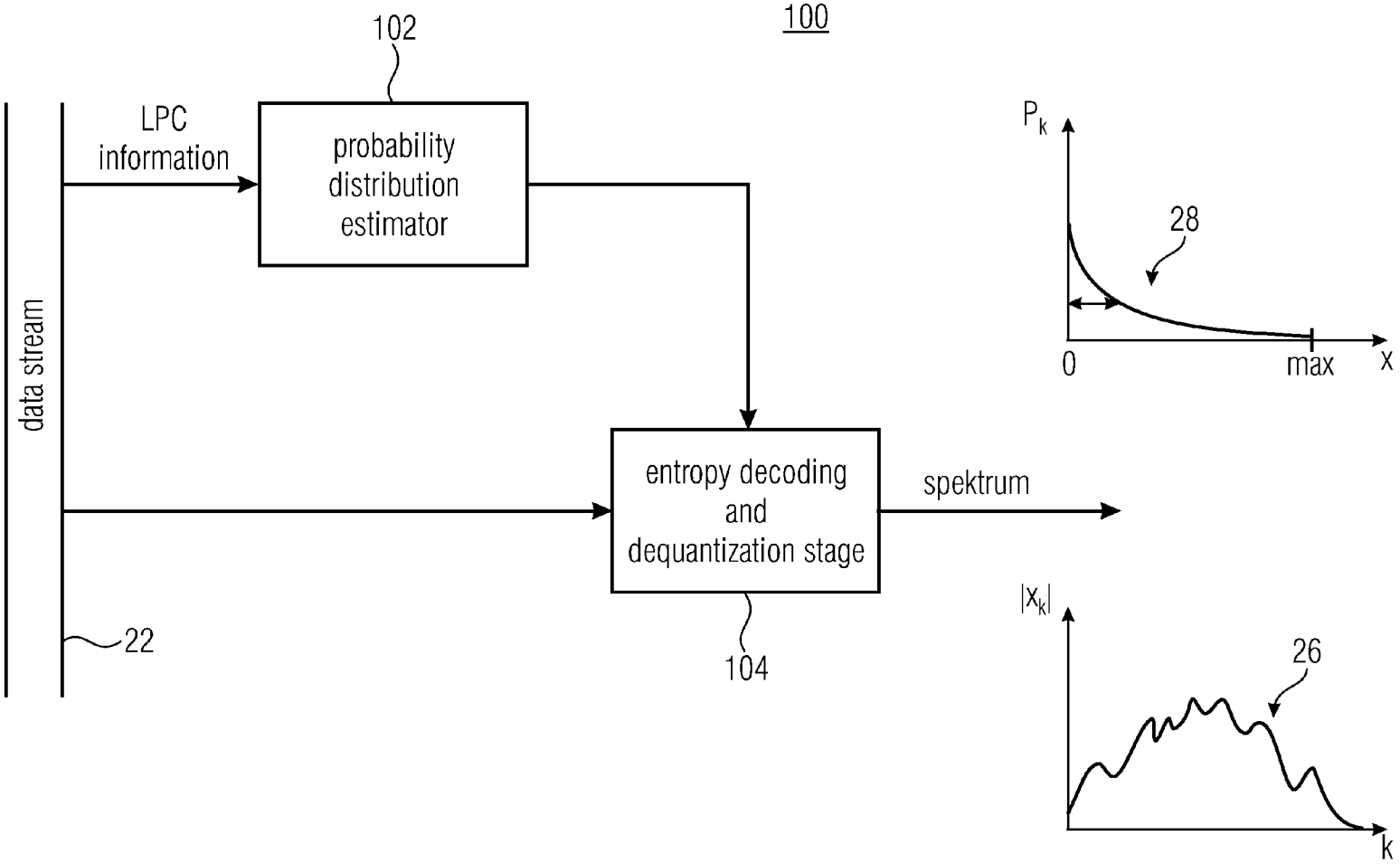
FIG. 7 shows a block diagram of a linear prediction based audio decoder in accordance with an embodiment.

After having described various embodiments for a linear prediction based audio encoder with respect to FIGS. 1 to 6, the following description concentrates on the decoding side. FIG. 7 shows an embodiment for a linear prediction based audio decoder 100. It comprises a probability distribution estimator 102 and an entropy decoding and dequantization stage 104. The linear prediction based audio decoder has access to the data stream 22 and while probability distribution estimator 102 is configured to determine, for each of the plurality of spectral components k, a probability distribution estimation 28 from the linear prediction coefficient information contained in the data stream 22, entropy decoding and dequantization stage 104 is configured to entropy decode and dequantize the spectrum 26 form the data stream 22 using the probability distribution estimation as determined for each of the plurality of spectral components k by probability distribution estimator 102. That is, both probability distribution estimator 102 and entropy decoding and dequantization stage 104 have access to data stream 22 and probability distribution estimator 102 has its output connected to an input of entropy decoding and dequantization stage 104. At the output of the latter, the spectrum 26 is obtained.

It should be noted that, naturally, the spectrum output by entropy decoding and dequantization stage 104 may be subject to further processing depending on the application. The output of decoder 100 does not necessarily need, however, to be the audio signal which is encoded into data stream 22, in temporal domain in order to, for example, be reproduced using loudspeakers. Rather, linear prediction based audio decoder 100 may interface to the input of, for example, the mixer of a conferencing system, a multi-channel or multi-object decoder or the like, and this interfacing may be in the spectral domain. Alternatively, the spectrum or some post-processed version thereof may be subject to spectral-to-time conversion by a spectral decomposition conversion such as an inverse transform using an overlap/add process as described further below.

As probability distribution estimator 102 has access to the same LPC information as probability distribution estimator 14 at the encoding side, probability distribution estimator 102 operates the same as the corresponding estimator at the encoding side except for, for example, the determination of the additional LTP parameter at the encoding side, the result of which determination is signaled to the decoding side via data stream 22. The entropy decoding and dequantization stage 104 is configured to use the probability distribution estimation in entropy decoding the spectral values of the spectrum 62, such as the magnitude levels from the data stream 22 and dequantize same equally for all spectral components so as to obtain the spectrum 26. As to the various possibilities for implementing the entropy coding, reference is made to the above statements converning the entropy encoding. Further, the same quantization rule is applied in an inverse direction relative to the one used at the encoding side so that all the alternatives an details described above with respect to entropy coding and quantization shall also apply for the decoder embodiments correspondingly. That is, for example, the entropy decoding and dequantization stage may be configured to use a constant quantization step size for dequantizing the magnitude levels and may use, for example, arithmetic decoding.

Figure 8:
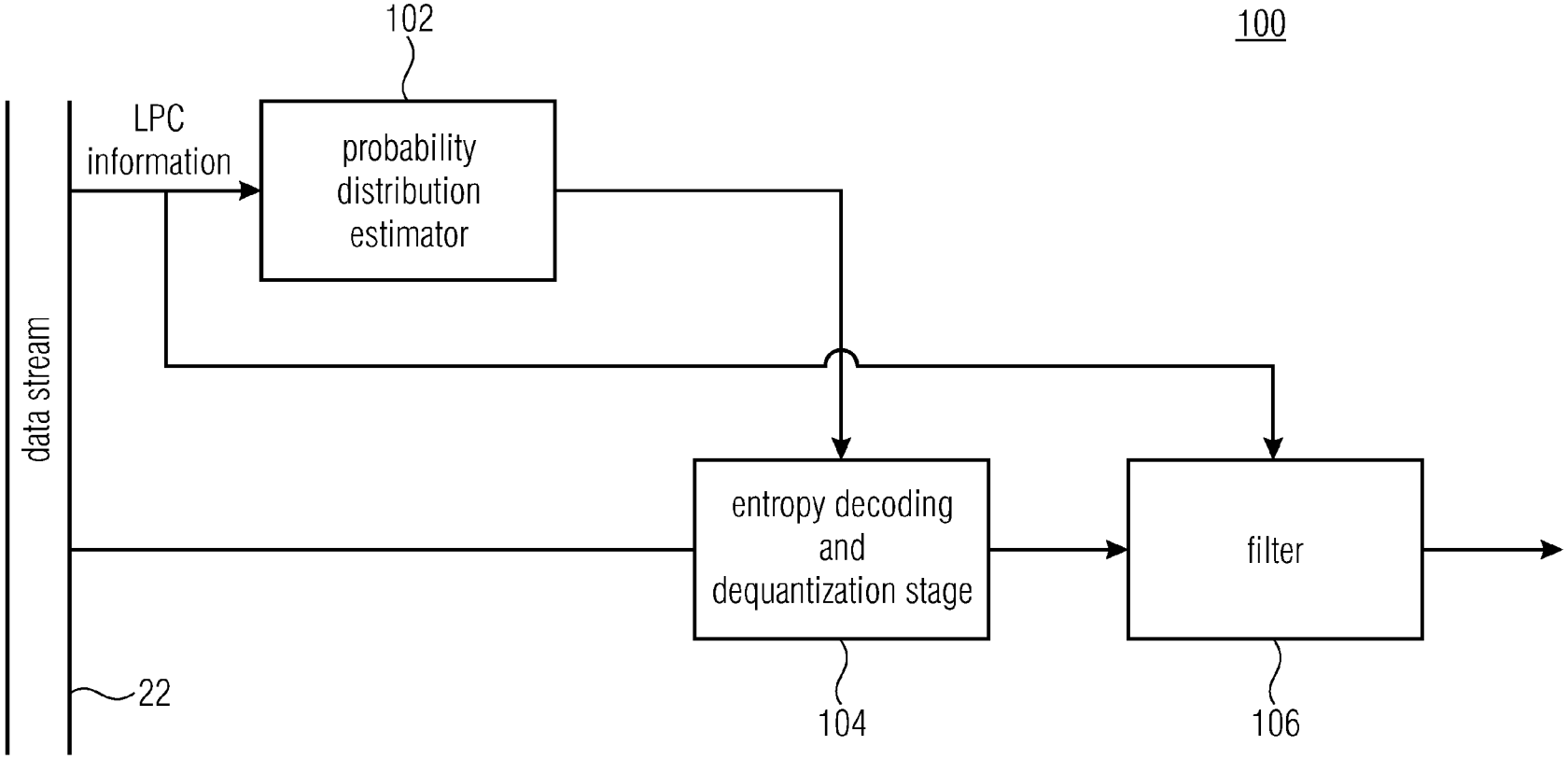
FIG. 8 shows a block diagram of a linear prediction based audio decoder in accordance with an even further embodiment.

As already denoted above, the spectrum 26 may represent a transform coding excitation and accordingly FIG. 8 shows that the linear prediction based audio decoder may additionally comprise a filter 106 which has also access to the LPC information and data stream 22 and is connected to the output of entropy decoding and dequantization stage 104 so as to receive spectrum 26 and output the spectrum of a post-filtered/reconstructed audio signal at its output. In particular, filter 106 is configured to shape the spectrum 26 according to a transfer function depending on a linear prediction synthesis filter defined by the linear prediction coefficient information. To be even more precise, filter 106 may be implemented by the concatenation of the scale factor determiner 34 and spectral shaper 38, with spectral shaper 38 receiving the spectrum 26 from stage 104 and outputting the post-filtered signal, i.e. the reconstructed audio signal. The only difference would be that the scaling performed within filter 106 would be exactly the inverse of the scaling performed by spectral shaper 38 at the encoding side, i.e. where spectral shaper 38 at the encoding side performs, for example, a multiplication using the scale factors, and in filter 106 a dividing by the scale factors would be performed or vice versa.

Figure 9:
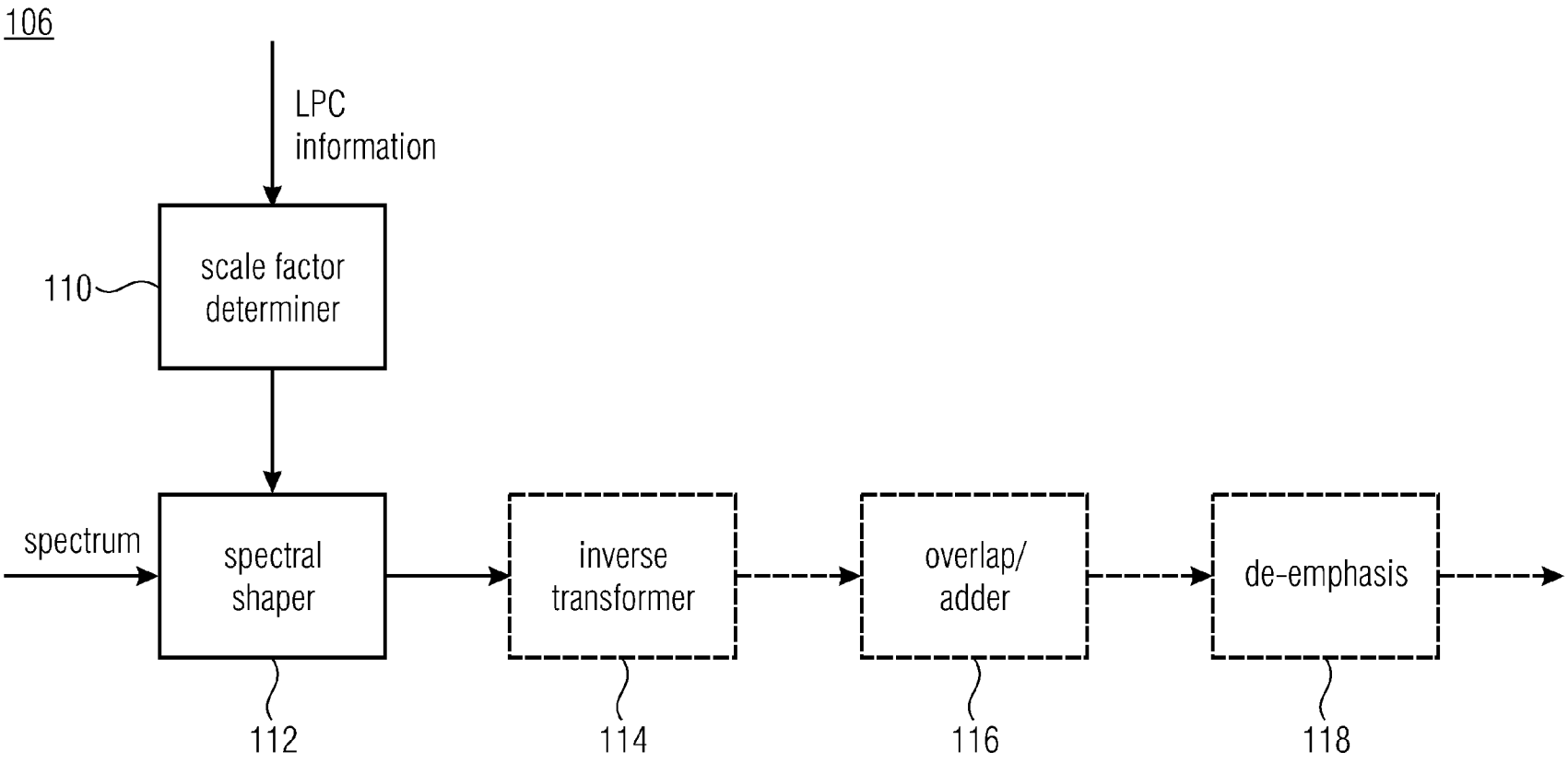
FIG. 9 shows a block diagram of the filter of FIG. 8 in accordance with an embodiment.

The latter circumstance is shown in FIG. 9, which shows an embodiment for filter 106 of FIG. 8. As can be seen, filter 108 may comprise a scale factor determiner 110 operating, for example, as the scale factor determiner 34 in FIG. 2 does, and a spectral shaper 112 which, as outlined above, applies the scale factors for scale factor determine 110 to the spectrum inbound, inversely relative to spectral shaper 38.

FIG. 9 illustrates that filter 106 may exemplarily further comprise an inverse transformer 114, an overlap adder 116 and a de-emphasis filter 118. The latter components 114 to 118 could be sequentially connected to the output of spectral shaper 112 in the order of their mentioning, wherein de-emphasis filter 118 or both overlap/adder 116 and de-emphasis filter 118 could, in accordance with a further alternative, be left away.

The de-emphasis filter 118 performs the inverse of the pre-emphasis filtering of filter 24 in FIG. 1 and the overlap/adder 116 may, as known in the art, result in aliasing cancellation in case of the inverse transform used within inverse transformer 114 being a critically sampled lapped transform. For example, the inverse transformer 114 could subject each spectrum 26 received from spectral shaper 112 at a temporal rate at which these spectrums are coded within data stream 22, to an inverse transform so as to obtain windowed portions which, in turn, are overlap-added by overlap/adder 116 to result in a time-domain signal version. The de-emphasis filter 118, just as the pre-emphasis filter 24 does, may be implemented as an FIR filter.

After having described embodiments of the present application with respect to the figures, in the following a more mathematical description of embodiments of the present application is provided with this description then ending in the corresponding description of FIGS. 10 and 11. In particular, in the embodiments described below it is assumed that unary binarization of the spectral values of the spectrum with binary arithmetic coding of the bins of the resulting bins sequences is used to code the spectrum.

In particular, in the exemplary details described below, which shall understood to be transferrable onto the above described embodiments, it has been exemplarily decided to calculate the envelope 30 structure in 64 bands when the frame length, i.e. the spectrum rate at which the spectrum 26 is updated within data stream 22, is 256 samples and 80 bands when the frame length is 320 samples. If the LPC model is A(z), then the weighted LPC is, for example, A(γz) with γ=0.92 and the associated pre-emphasis term of filter 24 is $(1-0.68\ z^{-1})$, for example wherein the constants may vary based on the application. The envelope 30 and the perceptual domain is thus $$\frac{A(0.92z)(1-0.68z^{-1})}{A(z)}. \tag{1}$$

Thus, the transfer function of the filter defined by formula (1) corresponds to function 48 in FIG. 3*b* and is the result of the computation in FIGS. 4 and 6 at the output of the divider 66.

It should be noted that FIGS. 4 and 6 represent the mode of operation of both the probability distribution estimator 14 and the probability distribution estimator 102 in FIG. 7. Moreover, in case of the pre-emphasis filter 24 and the de-emphasis filter 118 being used, the LPC to spectral weight conversion 60 takes the pre-emphasis filter function into account so that, at the end, it represents the product of the transfer functions of the synthesis filter and the pre-emphasis filter.

In any case, the time-frequency transform of the filter defined by formula (1) should be calculated such that the final envelope is frequency-aligned with the spectral representation of the input signal. Moreover, it should be noted again that the probability distribution estimator may merely compute the absolute magnitude of the envelope or transfer function of the filter of formula (1). In that case, the phase component can be discarded.

In case of calculating the envelope for spectral bands and not individual lines, the envelope applied to spectral lines will be step-wise continuous. To obtain a more continuous envelope it is possible to interpolate or smoothen the envelope. However, it should be observed that the step-wise continuous spectral bands provide a reduction in computational complexity. Therefore, this is a balance between accuracy versus complexity.

As noted before, the LTP can also be used to infer a more detailed envelope. Some of the main challenges of applying harmonic information to the envelope shape are:

1) Choosing the encoding and accuracy of LTP information such as LTP lag and LTP gain. For example, the same encoding as in ACELP could be used.
2) The LTP may correspond to a comb-filter in the frequency domain. However, the above embodiments or any other embodiment according to the present invention is not constrained to use a comb-filter of the same shape as the LTP. Other functions could be used as well.
3) In addition to the comb-filter shape of LTP, it is also possible to choose to apply the LTP differently in different frequency regions. For example, harmonic peaks are usually more prominent at low frequencies. It would then make sense to apply the harmonic model at the low frequency with higher amplitude than on high frequencies.
4) As noted above, the envelope shape is calculated band-wise. However, a comb-filter in LTP will certainly have a much more detailed structure and frequency than what the band-wise estimated envelope values have. In the implementation of a harmonic model, it is then beneficial to reduce computational complexity.

In the above embodiments, an assumption may be used according to which the individual lines or more specifically the magnitudes of the spectrum 26 at the spectral components k, are distributed according to the Laplace-distribution, that is, the signed exponential distribution. IN other words, aforementioned f(i,l(k)) may be a Laplace function. Since the sign of the spectrum 26 at the spectral component k can be encoded by one bit, and the probability of both signs can be safely assumed to be 0.5, then the sign can be encoded separately and we need to consider the exponential distribution only.

In general, without any prior information the first choice for any distribution would be the normal distribution. The exponential distribution, however, has much more probability mass close to zero than the normal distribution and it thus describes a more sparse signal than the normal distribution. Since one of the main goals of time-frequency transforms is to achieve a sparse signal, then a probability distribution that describes sparse signals is well-warranted. In addition, the exponential distribution also provides equations which are readily treatable in analytic form. These two arguments provide the basis to using the exponential distribution. The following derivations can naturally be readily modified for other distributions.

An exponentially distributed variable x has the probability density function (x≥0):

$$f(x;\lambda)=\lambda e^{-\lambda x} \tag{2}$$

and the cumulative distribution function $$F(x;\lambda)=1-e^{-\lambda x}. \tag{3}$$

The entropy of an exponential variable is 1−In(λ), whereby the expected bit-consumption of a single line, including sign, would be $\log_2(2e\lambda)$. However, this is a theoretical value which holds for discreet variables only when λ is large.

The actual bit-consumption can be estimated by simulations, but an accurate analytic formula is not available. An approximate bit-consumption is, though, $\log_2(2e\lambda+0.15+0.035/\lambda)$ for λ>0.08.

That is, the above described embodiments with the probability distribution estimator at encoding and decoding sides may use a Laplace distribution as a parameterizable function for determining the probability distribution estimation. The scale parameter λ of the Laplace distribution may serve as the aforementioned probability distribution parameter, i.e. as $\pi_k$.

Next, a possibility for performing envelope scaling is described. One approach is based on making a first guess for the scaling, calculating its bit-consumption and improving the scaling iteratively until sufficiently close to the desired level. In other words, the aforementioned probability distribution estimators at the encoding and decoding side could perform the following steps.

Let $f_k$ be the envelope value for position k. The average envelope value is then $$\hat{f}=\frac{1}{N}\sum_k f_k$$

where N is the number of spectral lines. If the desired bit-consumption is b, then the first-guess scaling go can be readily solved from $$\frac{b}{N}=\log_2\left(2e\hat{f}g_0+0.15-0.035(\hat{f}g_0)^{-1}\right).$$

The estimated bit-consumption $b_k$ for iteration k and with scaling $g_k$ is then $$b_k=\sum_h \log_2(2ef_hg_k+0.15+0.035(f_hg_k)^{-1}) \tag{4}$$

The logarithm operation is computationally complex, so we can instead calculate $$b_k=\log_2\prod_h(2ef_hg_k+0.15+0.035(f_hg_k)^{-1}) \tag{5}$$

Even though the product term is a very large number and its calculation in fixed-point necessitates a lot of administration, it is still less complex than a large number of $\log_2(\ )$ operations.

To further reduce complexity, we can estimate the bit consumption by $\log_2(2e\cdot\lambda)$, whereby the total bit consumption is b=log2 $\log_2\Pi\ 2e\cdot f_h\cdot g$. From this equation, the scaling coefficient g can be readily solved analytically, whereby the envelope-scaling iteration is not required.

In general, no analytic form exist for solving $g_k$ from Eq. 5, whereby an iterative method has to be used. If the bisection search is used, then if $b_0<b$, then the initial step size is $2^{(b-b_0)/N}-1$ and otherwise the step size is $1-2^{(b-0)/N}$. By this approach, the bisection search converges typically in 5-6 iterations.

The envelope has to be scaled equally both at the encoder as well as the decoder. Since the probability distributions are derived from the envelop, even a 1-bit difference in the scaling at encoder and decoder would cause the arithmetic decoder to produce random output. It is therefore very important that the implementation operates exactly equally on all platforms. In practice, this necessitates that the algorithm is implemented with integer and fixed-point operations.

While the envelope has already been scaled such that the expectation of the bit-consumption is equal to the desired level, the actual spectral lines will in general not match the bit-budget without scaling. Even if the signal would be scaled such that its variance matches the variance of the envelop, the sample distribution will invariably differ from the model distribution, whereby the desired bit-consumption is not reached. It is therefore necessitated to scale the signal such that when it is quantized and coded, the final bit-consumption reaches the desired level. Since this usually has to be performed in an iterative manner (no analytic solution exists), the process is known as the rate-loop.

We have chosen to start by a first-guess scaling such that the variance of the envelope and the scaled signal match. Simultaneously, we can find that spectral line, who has the smallest probability according to our probability model. Care is to be taken that the smallest probability value is not below machine-precision. This thus sets a limit on the scaling factor that will be estimated in the rate-loop.

For the rate-loop, we again employ the bisection search, such that the step size begins at half of the initial scale factor. Then the bit-consumption is calculated on each iteration as a sum of all spectral lines and the quantization accuracy is updated depending on how close to the bit-budget we are.

On each iteration, the signal is first quantized with the current scaling. Secondly, each line is coded with the arithmetic coder. According to the probability model, the probability that a line $x_k$ is quantized to zero is $p(x_k=0)=1-\exp(0.5/f_k)$, where $f_k$ is the envelope value (=standard deviation of the spectral line). The bit-consumption of such a line is naturally $-\log_2 p(x_k=0)$. A non-zero value $x_k$ has the probability $p(|x_k|=q)=\exp((q+0.5)/f_k)-\exp((q-0.5)/f_k)$. The magnitude can thus be encoded with $\log_2(p(|x_k|=q))$ bits, plus one bit for the sign.

In this way, the bit-consumption of the whole spectrum can be calculated. In addition, note that we can set a limit K such that all lines k>K are zero. It is then sufficient to encode the K first lines. The decoder can then deduce that if the K first lines have been decoded, but no additional bits are available, then the remaining lines are all zero. It is therefore not necessary to transmit the limit K, but it can be deduced from the bitstream. In this way, we can avoid encoding lines that are zero, whereby we save bits. Since for speech and audio signals it happens frequently that the upper part of the spectrum is quantized to zero, it is beneficial to start from the low frequencies, and as far as possible, use all-bits for the first K lines.

Note that since the envelope values $f_k$ are equal within a band, we can readily reduce complexity by pre-calculating values which are needed for every line in a band. Specifically, in encoding lines, the term $\exp(0.5/f_k)$ is needed and it is equal within every band. Moreover, this value does not change within the rate-loop, whereby it can be calculated outside the rate-loop and the same value can be used for the final quantization as well.

Moreover, since the bit-consumption of a line is $\log_2(\ )$ of the probability, we can, instead of calculating the sum of logarithms, calculate the logarithm of a product. This way complexity is again saved. In addition, since the rate-loop is an encoder-only feature, native floating point operations can be used instead of fixed-point.

Figure 10:
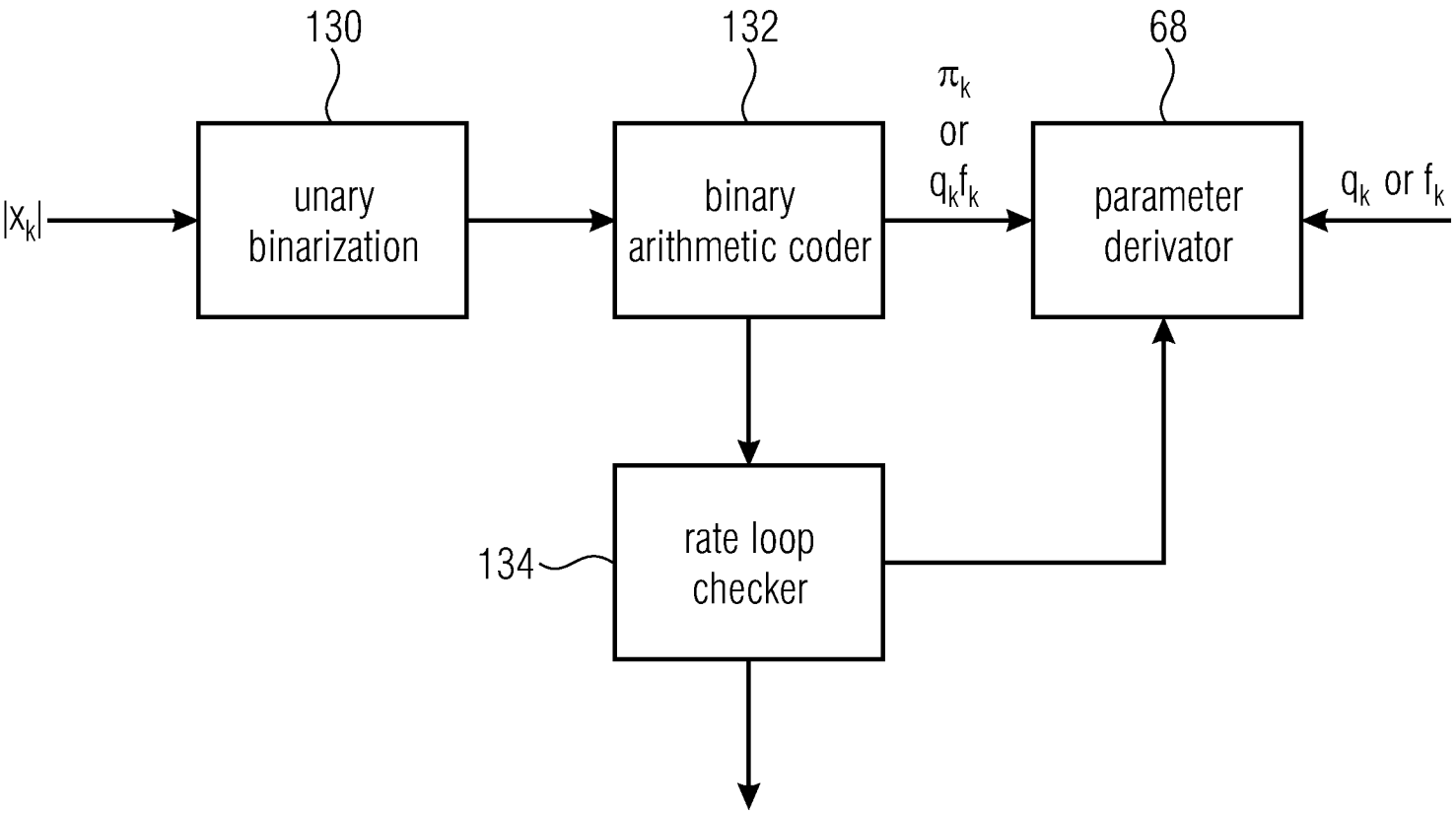
FIG. 10 shows a block diagram of a more detailed structure of a portion of the encoder of FIG. 1 positioned at quantization and entropy encoding stage and probability distribution estimator 14 in accordance with an embodiment.

Referring to the above, reference is made to FIG. 10, which shows a sub-portion out of the encoder explained above with respect to the figures, which portion is responsible for performing the aforementioned envelope scaling and rate loop in accordance with an embodiment. In particular, FIG. 10 shows elements out of the quantization and entropy encoding stage 18 on the one hand and the probability distribution estimator 14 on the other hand. A unary binarization binarizer 130 subjects the magnitudes of the spectral values $x_k$ of spectrum 26 at spectral components k to a unary binarization, thereby generating, for each magnitude at spectral component k, a sequence of bins. The binary arithmetic coder 132 receives these sequences of bins, i.e. one per spectral component k, and subjects same to binary arithmetic coding. Both unary binarization binarizer 130 and binary arithmetic coder 132 are part of the quantization and entropy coding stage 18. FIG. 10 also shows the parameter derivator 68, which is responsible for performing the aforementioned scaling in order to scale the envelope estimation values $q_k$, or as they were also denoted above by $f_k$, so as to result in correctly scaled probability distribution parameters $\pi_k$ or using the notation just used, $g_k f_k$. As described above using formula (5), binary derivator 68 determines the scaling value $g_k$ iteratively, so that the analytical estimation of the bit-consumption an example of which is represented by equation (5), meets some target bit rate for the whole spectrum 26. As a minor side note, it is noted that k as used in connection with equation (5) denoted the iteration step number while elsewhere variable k was meant to denote the spectral line or component k. Beyond that, it should be noted that parameter derivator 68 does not necessarily scale the original envelope values exemplarily derived as shown in FIGS. 4 and 6, but could alternatively directly iteratively modify the envelope values using, for example, additive modifiers.

In any case, the binary arithmetic coder 132 applies, for each spectral component, the probability distribution estimation as defined by probability distribution parameter $\pi_k$, or as alternatively used above, $g_k f_k$, for all bins of the unary binarization of the respective magnitude of the spectral values $x_k$.

As also described above, a rate loop checker 134 may be provided in order to check the actual bit-consumption produced by using the probability distribution parameters as determined by parameter derivator 68 as a first guess. The rate loop checker 134 checks the guess by being connected between binary arithmetic coder 132 and parameter derivator 68. If the actual bit-consumption exceeds the allowed bit-consumption despite the estimation performed by parameter derivator 68, rate loop checker 134 corrects the first guess values of the parameter distribution parameters $\pi_k$ (or $g_k f_k$), and the actual binary arithmetic coding 132 of the unary binarizations is performed again.

Figure 11:
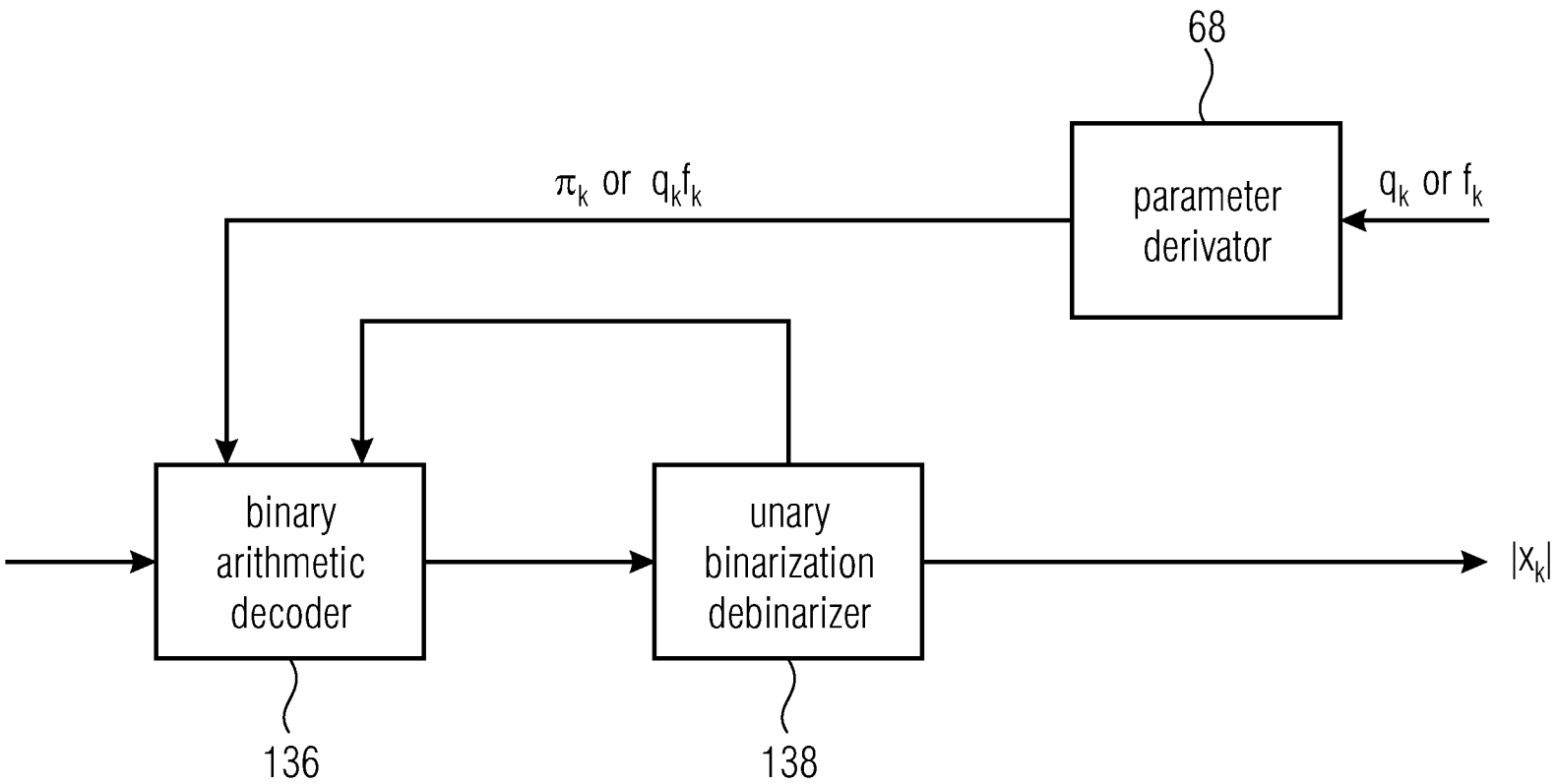

FIG. 11 shows for the sake of completeness a like portion out of the decoder of FIG. 8. In particular, the parameter derivator 68 operates at encoding and decoding side in the same manner and is accordingly likewise shown in FIG. 11. Instead of using a concatenation of unary binarization binarizer followed by a binary arithmetic coder, at the decoding side the inverse sequential arrangement is used, i.e. the entropy decoding and dequantization stage 104 in accordance with FIG. 11 exemplarily comprises a binary arithmetic decoder 136 followed by a unary binarization device debinarizer 138. The binary arithmetic decoder 136 receives the portion of the data stream 22 which arithmetically encodes spectrum 26. The output of binary arithmetic decoder 136 is a sequence of bin sequences, namely a sequence of bins of a certain magnitude of spectral value at spectral component k followed by the bin sequence of the magnitude of the spectral value of the following spectral component k+1 and so forth. Unary binarization debinarizer 138 performs the debinarization, i.e. outputs the debinarized magnitudes of the spectral values at spectral component k and informs the binary arithmetic decoder 136 on the beginning and end of the bin sequences of the individual magnitudes of the spectral values. Just as the binary arithmetic coder 132 does, binary arithmetic decoder 136 uses, per binary arithmetic decoding, the parameter distribution estimations defined by the parameter distribution parameters, namely the probability distribution parameter $\pi_k$ ($g_k f_k$), for all bins belonging to a respective magnitude of one spectral value of spectral component k.

As has also been described above, encoder and decoder may exploit the fact that both sides may be informed on the maximum bit rate available in that both sides may exploit the circumstance in that the actual encoding of the magnitudes of spectral values of spectrum 26 may be cheesed when traversing same from lowest frequency to highest frequency, as soon as the maximum bit rate available in the bitstream 22 has been reached. By convention, the non-transmitted magnitude may be set to zero.

With regard to the most recently described embodiments it is noted that, for example, the first guess scaling of the envelope for obtaining the probability distribution parameters maybe used without the rate loop for obeying the some constant bit rate such as for example, if the compliance is not requested by the application scenario, for example.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver .

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] ISO/IEC 23003-3:2012, "MPEG-D (MPEG audio technologies), Part 3: Unified speech and audio coding," 2012.

[2] J. Makhoul, "Linear prediction: A tutorial review," Proc. IEEE, vol. 63, no. 4, pp. 561-580, April 1975.

[3] G. Fuchs, V. Subbaraman, and M. Multrus, "Efficient context adaptive entropy coding for real-time applications," in *Acoustics, Speech and Signal Processing* (*ICASSP*), 2011 *IEEE International Conference* on, May 2011, pp. 493-496.

[4] U.S. Pat. No. 8,296,134 and WO2012046685.

The invention claimed is:

1. A linear prediction based audio decoder comprising:

a probability distribution estimator configured to determine, for each of a plurality of spectral components, a probability distribution estimation from linear prediction coefficient information comprised in a data stream into which an audio signal is encoded;

an entropy decoding and dequantization stage configured to entropy decode and dequantize a spectrum composed of the plurality of spectral components from the data stream using the probability distribution estimation as determined for each of the plurality of spectral components; and a filter configured to shape the spectrum according to a transfer function depending on a linear prediction synthesis filter defined by the linear prediction coefficient information, wherein the probability distribution estimator is configured to determine a spectral fine structure from long-term prediction parameters comprised in the data stream and determine, for each of the plurality of spectral components, a probability distribution parameter such that the probability distribution parameters spectrally follow a function which multiplicatively depends on the spectral fine structure, wherein, for each of the plurality of spectral components, the probability distribution estimation is a parameterizable function parameterized with the probability distribution parameter of the respective spectral component.

2. The linear prediction based audio decoder according to claim 1, further comprising:

a scale-factor determiner configured to determine scale factors based on the linear prediction coefficient information; and a spectral shaper configured to spectrally shape the spectrum by scaling the spectrum using the scale factors, wherein the scale factor determiner is configured to determine the scale factors such that same represent a transfer function depending on a linear prediction synthesis filter defined by the linear prediction coefficient information.

3. The linear prediction based audio decoder according to claim 1, wherein the transfer function's dependency on the linear prediction synthesis filter defined by the linear prediction coefficient information is such that the transfer function is perceptually weighted.

4. The linear prediction based audio decoder according to claim 1, wherein the transfer function's dependency on the linear prediction synthesis filter 1/A(z) defined by the linear prediction is such that the transfer function is a transfer function of 1/A(k·z), where k is a constant.

5. The linear prediction based audio decoder according to claim 1, wherein the probability distribution estimator is configured such that the spectral fine structure is a comb-like structure defined by the long-term prediction parameters.

6. The linear prediction based audio decoder according to claim 1, wherein the long-term prediction parameters comprise a long-term prediction gain and a long-term prediction pitch.

7. The linear prediction based audio decoder according to claim 1, wherein, for each of the plurality of spectral components, the parameterizable function is defined such that the probability distribution parameter is a measure for a dispersion of the probability distribution estimation.

8. The linear prediction based audio decoder according to claim 1, wherein, for each of the plurality of spectral components, the parameterizable function is a Laplace distribution, and the probability distribution parameter of the respective spectral component forms a scale parameter of the respective Laplace distribution.

9. The linear prediction based audio decoder according to claim 1, further comprising a de-emphasis filter.

10. The linear prediction based audio decoder according to claim 1, wherein the entropy decoding and dequantization stage is configured to, in dequantizing and entropy decoding the spectrum of the plurality of spectral components, treat sign and magnitude at the plurality of spectral components separately with using the probability distribution estimation as determined for each of the plurality of spectral components for the magnitude.

11. The linear prediction based audio decoder according to claim 1, wherein the entropy decoding and dequantizing stage is configured to use the probability distribution estimation in entropy decoding a magnitude level of the spectrum per spectral component and dequantize the magnitude levels equally for all spectral components so as to acquire the spectrum.

12. The linear prediction based audio decoder according to claim 11, wherein the entropy decoding and quantization stage is configured to use a constant quantization step size for dequantizing the magnitude levels.

13. The linear prediction based audio decoder according to claim 1, further comprising an inverse transformer configured to subject the spectrum to a real-valued critically sampled inverse transform so as to acquire an aliasing-suffering time-domain signal portion; and an overlap-adder configured to subject the aliasing-suffering time-domain signal portion to an overlap-and-add process with a preceding and/or succeeding time-domain portion so as to reconstruct the audio signal.

14. A linear prediction based audio encoder comprising:

a linear prediction analyzer configured to determine linear prediction coefficient information;

a probability distribution estimator configured to determine, for each of a plurality of spectral components, a probability distribution estimation from the linear prediction coefficient information; and a spectrum determiner configured to determine a spectrum composed of the plurality of spectral components from an audio signal;

a quantization and entropy encoding stage configured to quantize and entropy encode the spectrum using the probability distribution estimation as determined for each of the plurality of spectral components, wherein the spectrum determiner is configured to shape an original spectrum of the audio signal according to a transfer function which depends on an inverse of a linear prediction synthesis filter defined by the linear prediction coefficient information, and wherein the linear prediction based audio encoder further comprises a long-term predictor configured to determine long-term prediction parameters and the probability distribution estimator is configured to determine a spectral fine structure from the long-term prediction parameters and determine, for each of the plurality of spectral components, a probability distribution parameter such that the probability distribution parameters spectrally follow a function which depends on a product of a transfer function of the linear prediction synthesis filter, an inverse of a transfer function of a perceptually weighted modification of the linear prediction synthesis filter, and the spectral fine structure, wherein, for each of the plurality of spectral components, the probability distribution estimation is a parameterizable function parameterized with the probability distribution parameter of the respective spectral component.

15. The linear prediction based audio encoder according to claim 14, wherein the spectrum determiner comprises:

a scale-factor determiner configured to determine scale factors based on the linear prediction coefficient information;

a transformer configured to spectrally decompose the audio signal to acquire the original spectrum; and a spectral shaper configured to spectrally shape the original spectrum by scaling the spectrum using the scale factors, wherein the scale factor determiner is configured to determine the scale factors such that the spectral shaping by the spectral shaper using the scale factors corresponds to a transfer function which depends on an inverse of a linear prediction synthesis filter defined by the linear prediction coefficient information.

16. The linear prediction based audio encoder according to claim 14, wherein the transfer function's dependency on the inverse of the linear prediction synthesis filter defined by the linear prediction is such that the transfer function is perceptually weighted.

17. The linear prediction based audio encoder according to claim 14, wherein the transfer function's dependency on the inverse of the linear prediction synthesis filter 1/A(z) defined by the linear prediction coefficient information such that the transfer function is an inverse of a transfer function of 1/A(k·z), where k is a constant.

18. The linear prediction based audio encoder according to claim 14, wherein the probability distribution estimator is configured such that the spectral fine structure is a comb-like structure defined by the long-term prediction parameters.

19. The linear prediction based audio encoder according to claim 14, wherein the long-term prediction parameters comprise a long-term prediction gain and a long-term prediction pitch.

20. The linear prediction based audio encoder according to claim 14, wherein, for each of the plurality of spectral components, the parameterizable function is defined such that the probability distribution parameter is a measure for a dispersion of the probability distribution estimation.

21. The linear prediction based audio encoder according to claim 14, wherein, for each of the plurality of spectral components, the parameterizable function is a Laplace distribution, and the probability distribution parameter of the respective spectral component forms a scale parameter of the respective Laplace distribution.

22. The linear prediction based audio encoder according to claim 14, further comprising a pre-emphasis filter configured to subject the audio signal to a pre-emphasis.

23. The linear prediction based audio encoder according to claim 14, wherein the quantization and entropy encoding stage is configured to, in quantizing and entropy encoding the spectrum of the plurality of spectral components, treat sign and magnitude at the plurality of spectral components separately with using the probability distribution estimation as determined for each of the plurality of spectral components for the magnitude.

24. The linear prediction based audio encoder according to claim 14, wherein the quantization and entropy encoding stage is configured to quantize the spectrum equally for all spectral components so as to acquire magnitude levels for the spectral components and use the probability distribution estimation in entropy encoding the magnitude levels of the spectrum per spectral component.

25. The linear prediction based audio encoder according to claim 24, wherein the quantize and entropy encoding stage is configured to use a constant quantization step size for the quantizing.

26. The linear prediction based audio encoder according to claim 14, wherein the transformer is configured to perform a real-valued critically sampled transform.

27. A method for linear prediction based audio decoding, comprising:

determining, for each of a plurality of spectral components, a probability distribution estimation from linear prediction coefficient information comprised in a data stream into which an audio signal is encoded; and entropy decoding and dequantizing a spectrum composed of the plurality of spectral components from the data stream using the probability distribution estimation as determined for each of the plurality of spectral components, the method also comprising shaping the spectrum according to a transfer function depending on a linear prediction synthesis filter defined by the linear prediction coefficient information, wherein the determination of the probability distribution estimation comprises determining a spectral fine structure from long-term prediction parameters comprised in the data stream and determining, for each of the plurality of spectral components, a probability distribution parameter such that the probability distribution parameters spectrally follow a function which multiplicatively depends on the spectral fine structure, wherein, for each of the plurality of spectral components, the probability distribution estimation is a parameterizable function parameterized with the probability distribution parameter of the respective spectral component.

28. A method for linear prediction based audio encoding, comprising:

determining linear prediction coefficient information;

determining, for each of a plurality of spectral components, a probability distribution estimation from the linear prediction coefficient information; and determining a spectrum composed of the plurality of spectral components from an audio signal;

quantizing and entropy encoding the spectrum using the probability distribution estimation as determined for each of the plurality of spectral components, wherein the determination of the spectrum comprises shaping an original spectrum of the audio signal according to a transfer function which depends on an inverse of a linear prediction synthesis filter defined by the linear prediction coefficient information, and wherein the method further comprises determining long-term prediction parameters and the determination of the probability distribution comprises determining a spectral fine structure from the long-term prediction parameters and determining, for each of the plurality of spectral components, a probability distribution parameter such that the probability distribution parameters spectrally follow a function which depends on a product of a transfer function of the linear prediction synthesis filter, an inverse of a transfer function of a perceptually weighted modification of the linear prediction synthesis filter, and the spectral fine structure, wherein, for each of the plurality of spectral components, the probability distribution estimation is a parameterizable function parameterized with the probability distribution parameter of the respective spectral component.

29. A non-transitory computer readable medium including a computer program comprising a program code for performing, when running on a computer, a method according to claim 27.

30. A non-transitory computer readable medium including a computer program comprising a program code for performing, when running on a computer, a method according to claim 28.

* * * * *